US012447574B2

(12) United States Patent
Valentini

(10) Patent No.: US 12,447,574 B2
(45) Date of Patent: Oct. 21, 2025

(54) HAND-HELD AND HAND-GUIDED RANDOM ORBITAL POLISHING OR SANDING POWER TOOL

(71) Applicant: Guido Valentini, Milan (IT)

(72) Inventor: Guido Valentini, Milan (IT)

(73) Assignee: Guido Valentini, Milan (IT)

( * ) Notice: Subject to any disclaimer, the term of this patent is extended or adjusted under 35 U.S.C. 154(b) by 1195 days.

(21) Appl. No.: 16/665,464

(22) Filed: Oct. 28, 2019

(65) Prior Publication Data

US 2020/0189065 A1 Jun. 18, 2020

(30) Foreign Application Priority Data

Oct. 29, 2018 (EP) ..... 18203143

(51) Int. Cl.
*B24B 23/02* (2006.01)

(52) U.S. Cl.
CPC ..... *B24B 23/028* (2013.01)

(58) Field of Classification Search
None
See application file for complete search history.

(56) References Cited

U.S. PATENT DOCUMENTS 5,425,666 A 6/1995 Frank et al.
5,496,207 A * 3/1996 Hornung ..... B24B 23/03 451/344

(Continued)

FOREIGN PATENT DOCUMENTS

CN 101981785 A 2/2011
CN 202158160 U 3/2012

(Continued)

OTHER PUBLICATIONS

English language Abstract of EP0591875 (see also U.S. Pat. No. 5,425,666).

(Continued)

*Primary Examiner* — Orlando E Aviles
*Assistant Examiner* — Jason Khalil Hawkins
(74) *Attorney, Agent, or Firm* — William J. Barber; WARE FRESSOLA MAGUIRE & BARBER LLP

(57) ABSTRACT

The invention refers to a hand-held and hand-guided random orbital polishing or sanding power tool (1). The tool (1) comprises a static body (31), a motor (15), an eccentric element (17) driven by the motor (15) and performing a rotational movement about a first rotational axis (10), and a plate-like backing pad (9) connected to the eccentric element (17) in a manner freely rotatable about a second rotational axis (16). The first and second rotational axes (10, 16) extend essentially parallel to one another and are spaced apart from one another. In order to provide for a power tool (1) particularly quiet and low in vibrations, it is suggested that at least part of an external circumferential surface of the eccentric element (17) has an at least discrete rotational symmetry in respect to the first rotational axis (10); and the power tool (1) comprises at least one first bearing (30) provided between the rotationally symmetric part of the external circumferential surface of the eccentric element (17) and the static body (31) of the power tool (1) so that the eccentric element (17) is guided in respect to the body (31) in a manner rotatable about the first rotational axis (10).

14 Claims, 26 Drawing Sheets

(56) References Cited

U.S. PATENT DOCUMENTS

Figure 1:
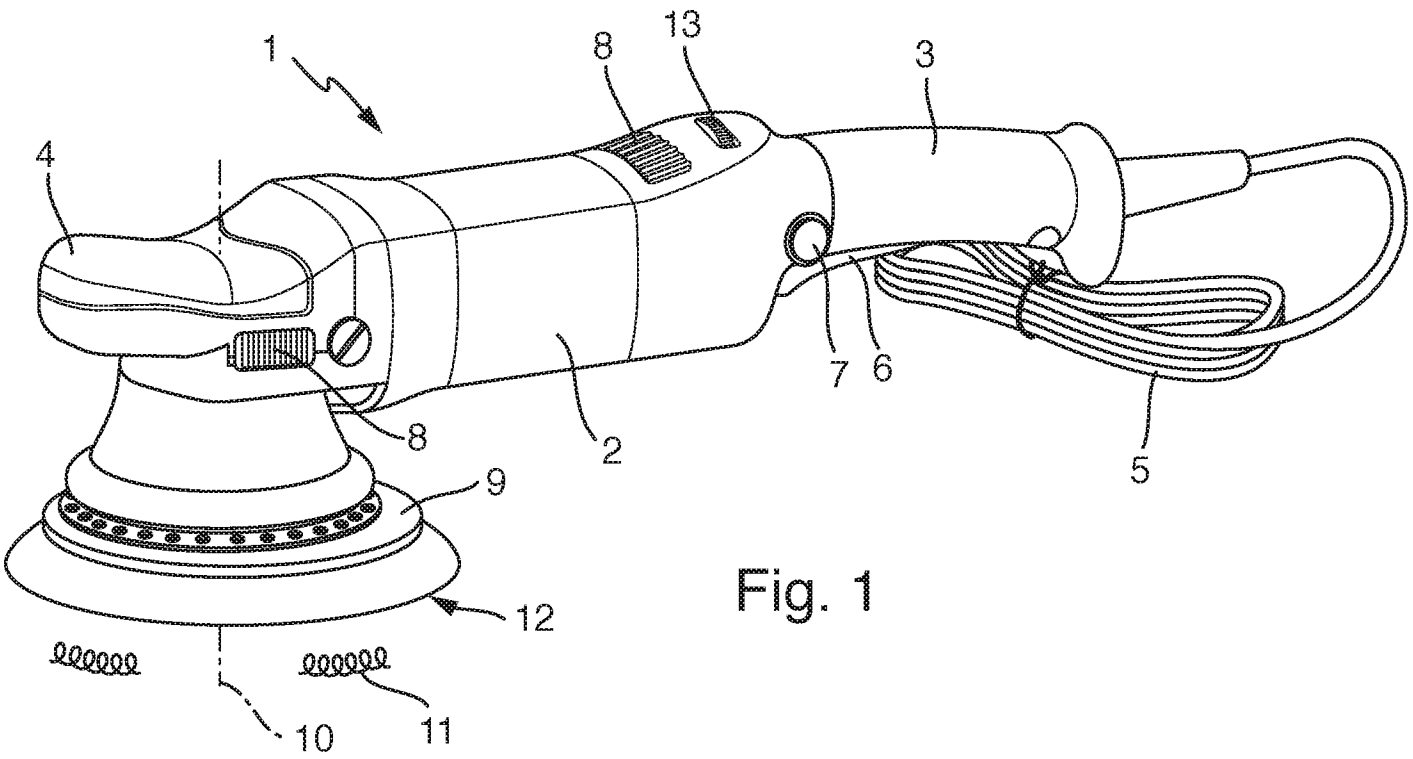

| | | | | |
|---|---|---|---|---|
| 2011/0025158 | A1 | 2/2011 | Aiki et al. | |
| 2013/0284551 | A1* | 10/2013 | Nadig | F16D 63/002 188/267 |
| 2014/0034434 | A1* | 2/2014 | Esenwein | H02K 7/104 188/267 |
| 2017/0312877 | A1* | 11/2017 | Valentini | B24B 47/12 |
| 2019/0240798 | A1* | 8/2019 | Valentini | B24B 23/02 |

FOREIGN PATENT DOCUMENTS

| | | | |
|---|---|---|---|
| CN | 203166659 | U | 8/2013 |
| CN | 103862351 | A | 6/2014 |
| CN | 108290265 | A | 7/2018 |
| EP | 0591875 | A1 | 4/1994 |
| EP | 2113990 | A2 | 11/2009 |
| WO | 2012023245 | A1 | 2/2012 |
| WO | 2017097701 | A1 | 6/2017 |

OTHER PUBLICATIONS

English language translation of CN103862351A.
English language translation of CN202158160U.

* cited by examiner

A - A

HAND-HELD AND HAND-GUIDED RANDOM ORBITAL POLISHING OR SANDING POWER TOOL

The present invention refers to a hand-held and hand-guided random orbital polishing or sanding power tool. The power tool comprises a static body, a motor, an eccentric element driven by the motor and performing a rotational movement about a first rotational axis, and a plate-like backing pad connected to the eccentric element in a manner freely rotatable about a second rotational axis. The first and second rotational axes extend essentially parallel to one another and are spaced apart from one another.

Power tools of the above-identified kind are well-known in the prior art. The static body of the power tool is a fixed part of the power tool which does not move during operation of the power tool. The static body could be fixed to a housing of the power tool or could be the housing itself. The motor for driving the eccentric element may be an electric or a pneumatic motor. The eccentric element may be driven directly or indirectly by the motor, for example through a transmission or gear arrangement. The eccentric element is attached to a driving shaft, which may be the motor shaft or an output shaft from a transmission or gear arrangement. A rotational axis of the driving shaft corresponds to a first rotational axis of the eccentric element. The backing pad is connected to the eccentric element in a manner freely rotatable about a second rotational axis. During operation of the power tool the eccentric element rotates about the first rotational axis. The second rotational axis, which is spaced apart from the first rotational axis, also performs a rotational movement about the first rotational axis. Hence, the backing pad performs an eccentric or orbital movement in its plane of extension. The possibility for the backing pad to freely rotate about the second rotational axis makes the eccentric or orbital movement a random orbital movement. For example, a pneumatic random orbital power tool of the above-mentioned kind is known from US 2004/0 102 145 A1 and from U.S. Pat. No. 5,319,888. A respective electric power tool is known, for example, from EP 0 694 365 A1.

It is common with all known random orbital power tools that the driving shaft, which is attached to the eccentric element, is guided by one or more bearings to allow its rotation about the first rotational axis. The eccentric element, which is attached to the driving shaft in a torque proof manner, has no separate bearings. During rotation about the first rotational axis the eccentric element is only guided by the bearings assigned to the driving shaft. In this conventional construction of the known power tools the eccentric element is spaced apart rather far from the bearings assigned to the driving shaft. This may not be a problem if the eccentric element simply performed a rotational movement about the first rotational axis without any lateral forces exerting on it. However, this is not the case in random orbital power tools. Due to the rather high weight of the eccentric element (including the backing pad and a counter weight connected thereto) in combination with the eccentric movement about the first rotational axis at rather high speeds (up to 12,000 rpm), there are considerable lateral forces exerting on the eccentric element and the driving shaft to which it is attached. This leads to a rather high moment exerting on the driving shaft and the bearings guiding it.

Furthermore, it is mandatory in the known random orbital power tools that the eccentric element is fixedly attached to the driving shaft or forms an integral part of the driving shaft. This means a significant limitation in the development of new and further development of existing power tools.

Therefore, it is an object of the present invention to propose a power tool of the above-identified kind which overcomes the mentioned drawbacks.

This object is achieved by a power tool comprising the features of claim 1. In particular, it is suggested that in the power tool of the above-identified kind

- at least part of an external circumferential surface of the eccentric element has an at least discrete rotational symmetry in respect to the first rotational axis; and
- the power tool comprises at least one first bearing provided between the rotationally symmetric part of the external circumferential surface of the eccentric element and the static body of the power tool so that the eccentric element is guided in respect to the body in a manner rotatable about the first rotational axis.

It is an important aspect of the present invention to provide the eccentric element of a random orbital power tool with at least one separate bearing for directly guiding the eccentric element during its rotation about the first rotational axis in respect to the static body. The at least one bearing can absorb the lateral forces directly from the rotating eccentric element (including the backing pad and a counter weight connected thereto). This has the advantage that vibrations of the power tool during its operation resulting from the eccentric element (including the backing pad and a counter weight connected thereto) at high speeds (up to 12,000 rpm) can be significantly reduced. Preferably, the eccentric element is provided with at least two bearings spaced apart from each other in the direction of the first rotational axis, in particular located at opposite ends of the eccentric element along the first rotational axis. This can provide for a large effective distance between two support bearings and allows absorption of larger tilting moments. The at least one bearing is preferably an annular ball race. In particular, it is suggested that at least two inclined support bearings are configured as an O-arrangement. This can further increase the effective distance between the two support bearings and allows absorption of even larger tilting moments.

The external circumferential surface of the eccentric element has a larger diameter than the driving shaft. Hence, the at least one bearing provided on the rotationally symmetric part of the external circumferential surface of the eccentric element also has a larger diameter than a bearing provided on the outer surface of the driving shaft in the prior art. Due to the larger diameter, the at least one bearing provided between the eccentric element and the static body can better receive and absorb vibrations from the eccentric element.

The motor for driving the eccentric element may be an electric or a pneumatic motor. The eccentric element may be driven directly or indirectly by the motor, for example through a transmission or gear arrangement. The eccentric element is attached to the driving shaft, which may be the motor shaft or an output shaft from a transmission or gear arrangement. A rotational axis of the driving shaft corresponds to a first rotational axis of the eccentric element. In case the eccentric element is fixedly attached to or forms an integral part of a driving shaft, the eccentric element could be provided with only one bearing located at an end of the eccentric element opposite to the driving shaft. A further bearing could be assigned to the driving shaft, which can further increase the effective distance between the two support bearings and allows absorption of even larger tilting moments.

In order to allow a direct guiding of the eccentric element by means of the at least one bearing, at least part of the external circumferential surface of the eccentric element, where the at least one bearing is provided, has an at least discrete rotational symmetry in respect to the first rotational axis. Rotational symmetry of order n, also called n-fold rotational symmetry, or discrete rotational symmetry of the $n^{th}$ order of an object, with respect to a particular point (in 2D) or axis (in 3D) means that rotation of the object by an angle of 360°/n does not change the object. "1-fold" symmetry is no symmetry because all objects look alike after a rotation of 360°. Preferably, the rotationally symmetric part of the external circumferential surface of the eccentric element has a rotational symmetry in respect to a rotation about the first rotational axis by any angle (so-called circular symmetry). This means that the rotationally symmetric part of the external circumferential surface of the eccentric element has a cylindrical form, wherein the cylinder axis corresponds to the first rotational axis of the eccentric element. The at least one bearing is provided on the cylindrical part of the eccentric element and guides the eccentric element in respect to the static body (e.g. the housing or a separate chassis attached to the housing) of the power tool.

According to a preferred embodiment of the present invention it is suggested that the eccentric element comprises an eccentric seat where a fulcrum pin is inserted and guided in a freely rotatable manner about the second rotational axis. The fulcrum pin comprises attachment means, e.g. an enlarged head portion, to which the backing pad may be releasably attached. To this end, a recess is provided on a top surface of the backing pad, wherein the internal circumferential form of the recess corresponds to the external circumferential form of the attachment means. The attachment means are held in the recess of the backing pad in an axial direction by means of a screw or magnetic force. Preferably, the eccentric element comprises at least one second bearing at the eccentric seat and acting between the eccentric element and the fulcrum pin so that the fulcrum pin is guided in respect to the eccentric element in a freely rotatable manner about the second rotational axis.

According to another preferred embodiment of the present invention it is suggested that the first bearing or at least one of the first bearings is located on the rotationally symmetric part of the external circumferential surface of the eccentric element in such a manner that it surrounds at least part of the at least one second bearing. With other words, the first bearing or at least one of the first bearings and the second bearing are located in the same horizontal plane extending perpendicular to the first rotational axis. This provides for a particularly good and effective absorption of the lateral forces introduced into the eccentric element by the backing pad through the fulcrum pin, which is guided in the at least one second bearing.

According to yet another preferred embodiment of the present invention, the power tool comprises a magnetic transmission arrangement provided functionally between a driving shaft and the eccentric element, the driving shaft having a rotational axis corresponding to the first rotational axis of the eccentric element, the transmission arrangement comprising a first number of first permanent magnets attached to the driving shaft with alternating polarities, and a second number of second permanent magnets attached to the eccentric element with alternating polarities and opposite to the first permanent magnets. The first permanent magnets are preferably attached to a circumferential outer surface of the driving shaft, and the second permanent magnets are preferably attached to a circumferential inner surface of the eccentric element. Magnetic transmission arrangements are principally well-known in the prior art. It is particularly advantageous to use a magnetic transmission arrangement in a power tool because the eccentric element is decoupled from the driving shaft and possible vibrations of the eccentric element during operation of the power tool are no longer transmitted to the driving shaft and the rest of the power tool, respectively. However, a decoupling is possible in the power tool according to the present invention only because the eccentric element is associated with at least one separate bearing for guiding the eccentric element in respect to the static body of the power tool independent of the driving shaft. The magnetic transmission arrangement of this embodiment may be of a radial type with the magnetic field between the first permanent magnets and the second permanent magnets extending in an essentially radial direction.

Alternatively, the magnetic transmission arrangement may be of an axial type with the magnetic field between the first permanent magnets and the second permanent magnets extending in an essentially axial direction, that is essentially parallel to the rotational axes. To this end it is suggested that the power tool comprises a magnetic transmission arrangement provided functionally between a driving shaft and the eccentric element, the driving shaft having a rotational axis corresponding to the first rotational axis of the eccentric element, the transmission arrangement comprising a first number of first permanent magnets attached to the driving shaft with alternating polarities and opposite to the side of the eccentric element to which the backing pad is connected, and a second number of second permanent magnets attached to an end face of the eccentric element with alternating polarities and opposite to the first permanent magnets.

The magnetic transmission arrangement may simply provide for a decoupling effect between the eccentric element and the driving shaft (gear ratio of 1). Alternatively, the transmission arrangement can also have the characteristic of a gear mechanism with a gear ratio $\neq 1$. In particular, it is suggested that the magnetic transmission arrangement has a gear ratio of $>1$, which means that the eccentric element rotates at a lower speed about the first rotational axis than the driving shaft, thereby increasing the torque at the eccentric element and, consequently, at the backing pad. A gear ratio of 1 can be achieved by providing the same number of first permanent magnets and second permanent magnets on the driving shaft and the eccentric element, respectively. A gear ratio $\neq 1$ can be achieved by providing a different number of first permanent magnets and second permanent magnets on the respective parts.

To this end it is suggested that the magnetic transmission arrangement further comprises a modulator with a third number of ferromagnetic segments attached to the static body of the power tool, wherein the ferromagnetic segments are located between the first permanent magnets and the second permanent magnets. The modulator optimises the magnetic flux between the first permanent magnets and the second permanent magnets.

According to a preferred embodiment of the present invention, it is suggested that the motor of the power tool is an electric motor with electric windings of a stator of the motor attached to the body of the power tool and permanent magnets of a rotor of the motor attached to the eccentric element. In this embodiment the electric motor is integrated into the eccentric element allowing the construction of a comparatively flat housing of a power tool with the electric motor and the eccentric element located therein. The electric motor is of a radial type with the magnetic field between the electric stator windings and the permanent magnets of the rotor extending in an essentially radial direction. In the case of an electric motor of the radial type, a distinction can be made between two types of construction, a so-called outrunner and a so-called inrunner.

It is suggested that the electric motor is of the outrunner type with the electric stator windings located between the first rotational axis of the eccentric element and a part of the external eccentric element to which the permanent magnets are attached. In particular, the eccentric element may have a central recess in an end face opposite to the backing pad, which receives the electric stator windings of the motor. The permanent magnets are fixedly attached to an inner circumferential wall of the central recess with alternating polarity.

Alternatively, it is suggested that the electric motor is of the inrunner type with a part of the eccentric element to which the permanent magnets are attached located between the first rotational axis of the eccentric element and the external electric stator windings. In particular, the electric stator windings surround at least part of the eccentric element. The permanent magnets are fixedly attached to an outer circumferential wall of that part of the eccentric element, which is surrounded by the electric stator windings.

The electric motor could also be of an axial type with the magnetic field between the electric stator windings and the permanent magnets of the rotor extending in an essentially axial direction, that is essentially parallel to the rotational. To this end it is suggested that the electric motor is of the axial type with the stator windings located circumferentially around the first rotational axis of the eccentric element and on a side of the eccentric element opposite to the side of the eccentric element to which the backing pad is connected, wherein the stator windings are oriented in such a manner that a magnetic flux generated by the stator windings is directed axially, and with the permanent magnets attached to an end face of the eccentric element facing the stator windings and located circumferentially around the first rotational axis of the eccentric element.

Furthermore, according to another preferred embodiment of the present invention it is suggested that the power tool comprises a turbine attached to or forming an integral part of the eccentric element on a part of the eccentric element directed towards the backing pad connected thereto. Such a turbine comprises a plurality of fins, which upon rotation of the turbine about the first rotational axis create a radial or an axial air flow. The air flow can be used for cooling internal components of the power tool (e.g. electronic components such as an electric motor, an electronic control unit, electronic valves and switches, electric inductors or the like, or pneumatic components such as a pneumatic motor, pneumatic valves and switches) and/or for aspiring dust and other small particles (e.g. grinding dust, polishing dust, particles from a polishing agent) from the surface currently worked by the power tool and/or from the surrounding environment and for conveying the aspired dust and other small particles to a filter unit attached to the power tool or to a vacuum cleaner. This embodiment has the advantage that the unit comprising the eccentric element and the turbine and possibly further comprising a magnetic transmission arrangement or an electric motor is particularly compact and has a flat design. The unit integrates a plurality of different components in a very small space.

To yet another preferred embodiment of the present invention, it is suggested that the power tool comprises a counter weight attached to or forming an integral part of the eccentric element or the turbine on a part of the eccentric element directed towards the backing pad connected thereto. The counter weight can be a separate element which is attached and fixed to the eccentric element, for example by means of a screw. Alternatively, the counter weight can be formed as an integral part of the eccentric element or the turbine, if a turbine is present.

Figure 2:
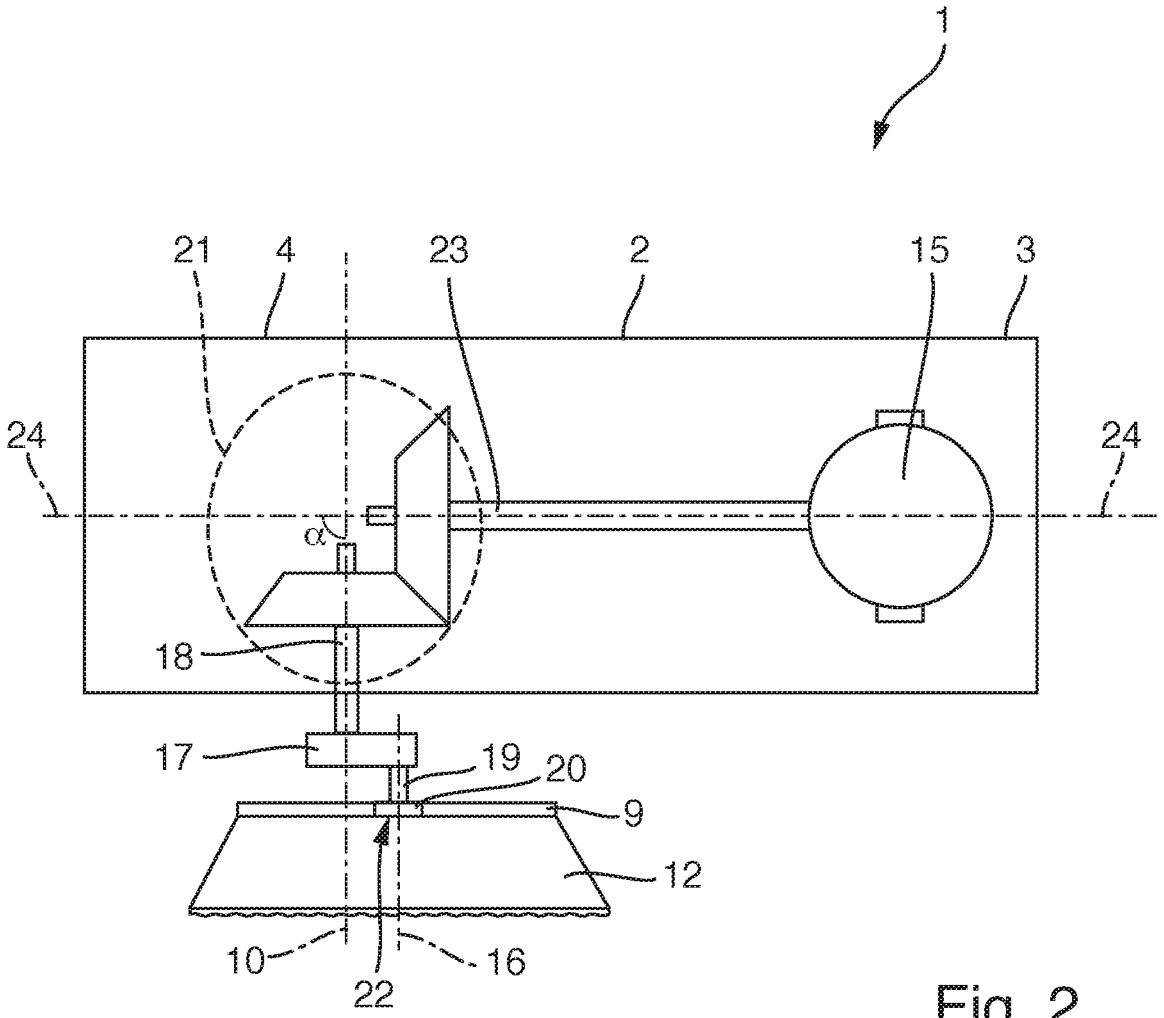
Figure 3A:
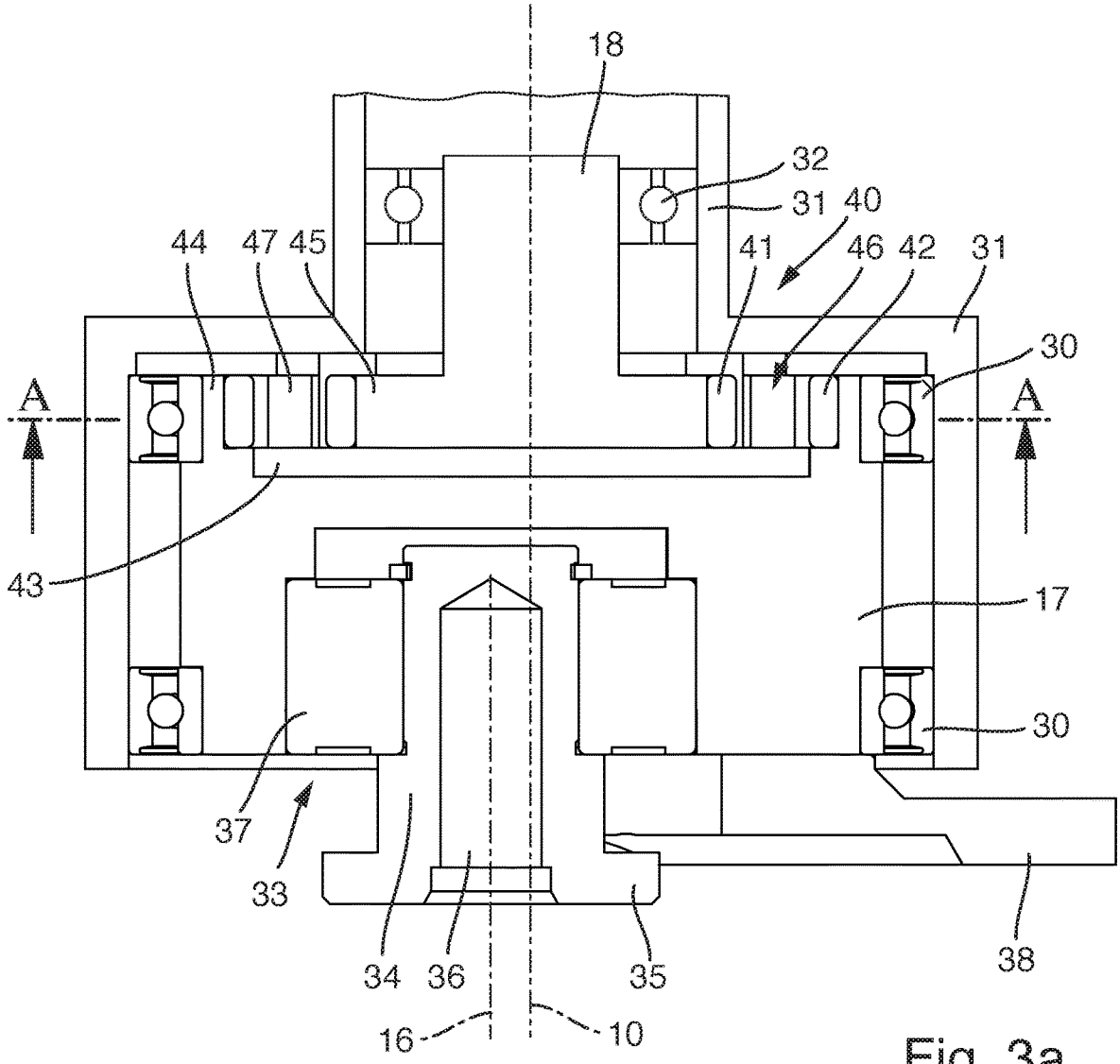
Figure 3B:
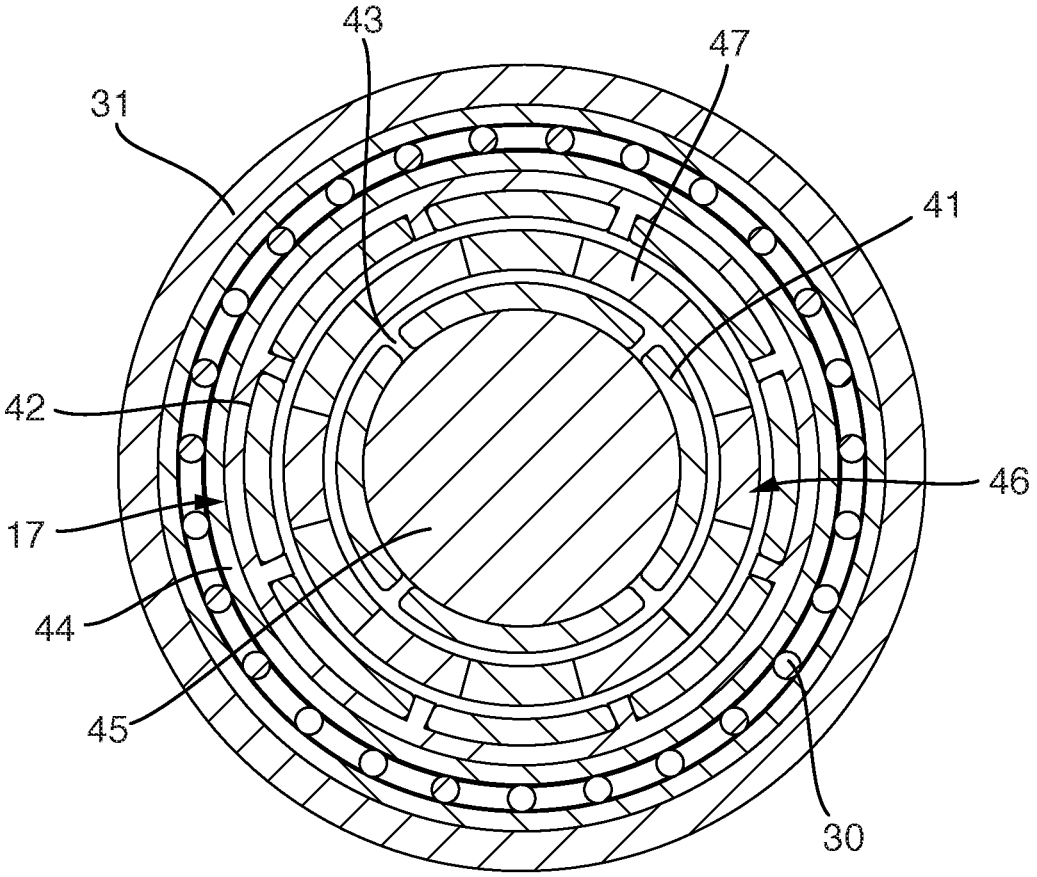
Figure 4A:
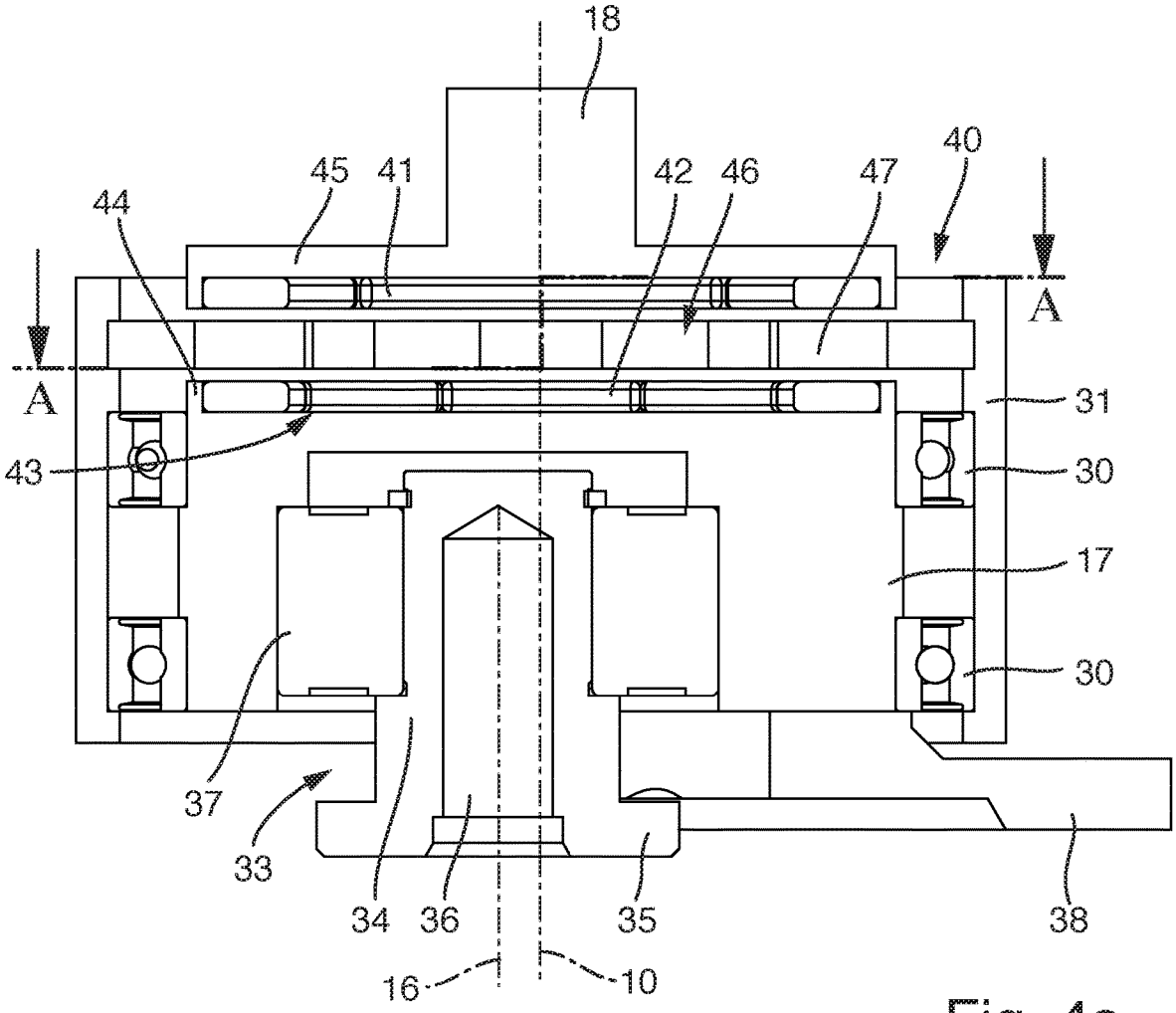
Figure 4B:
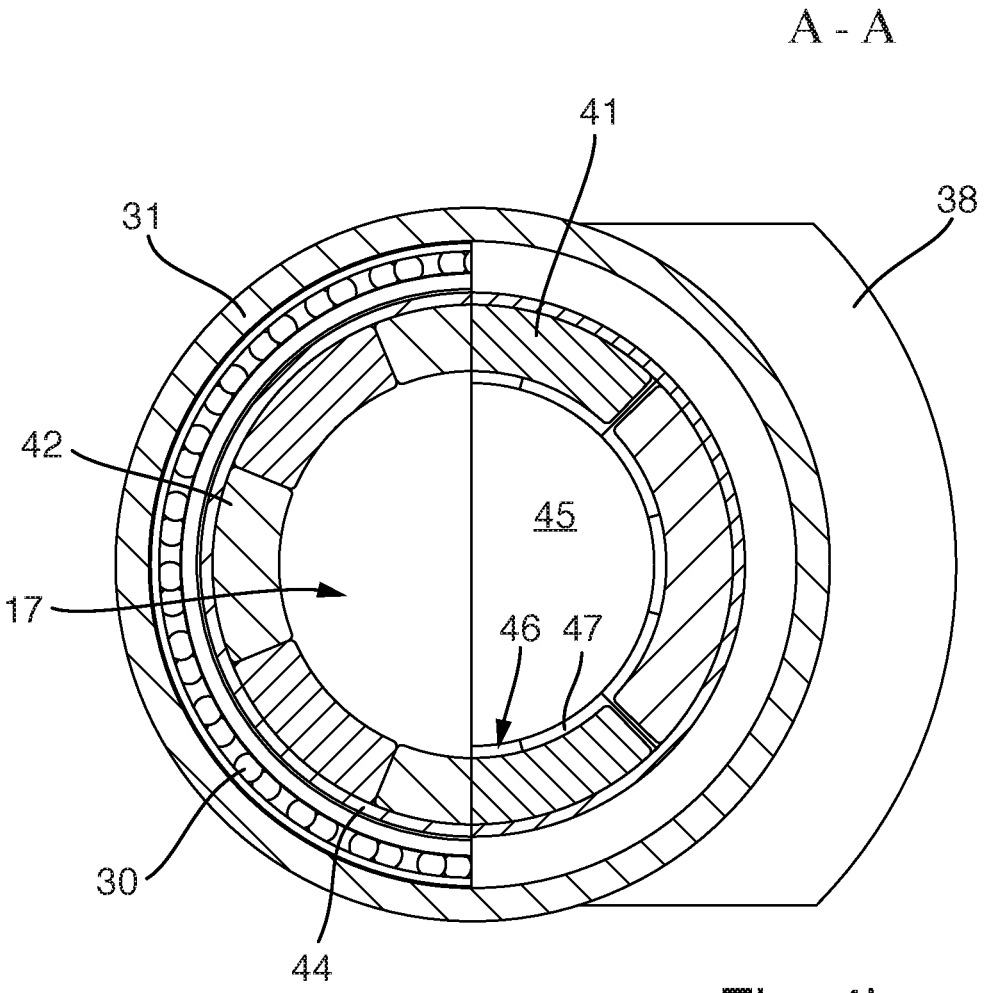
Figure 5:
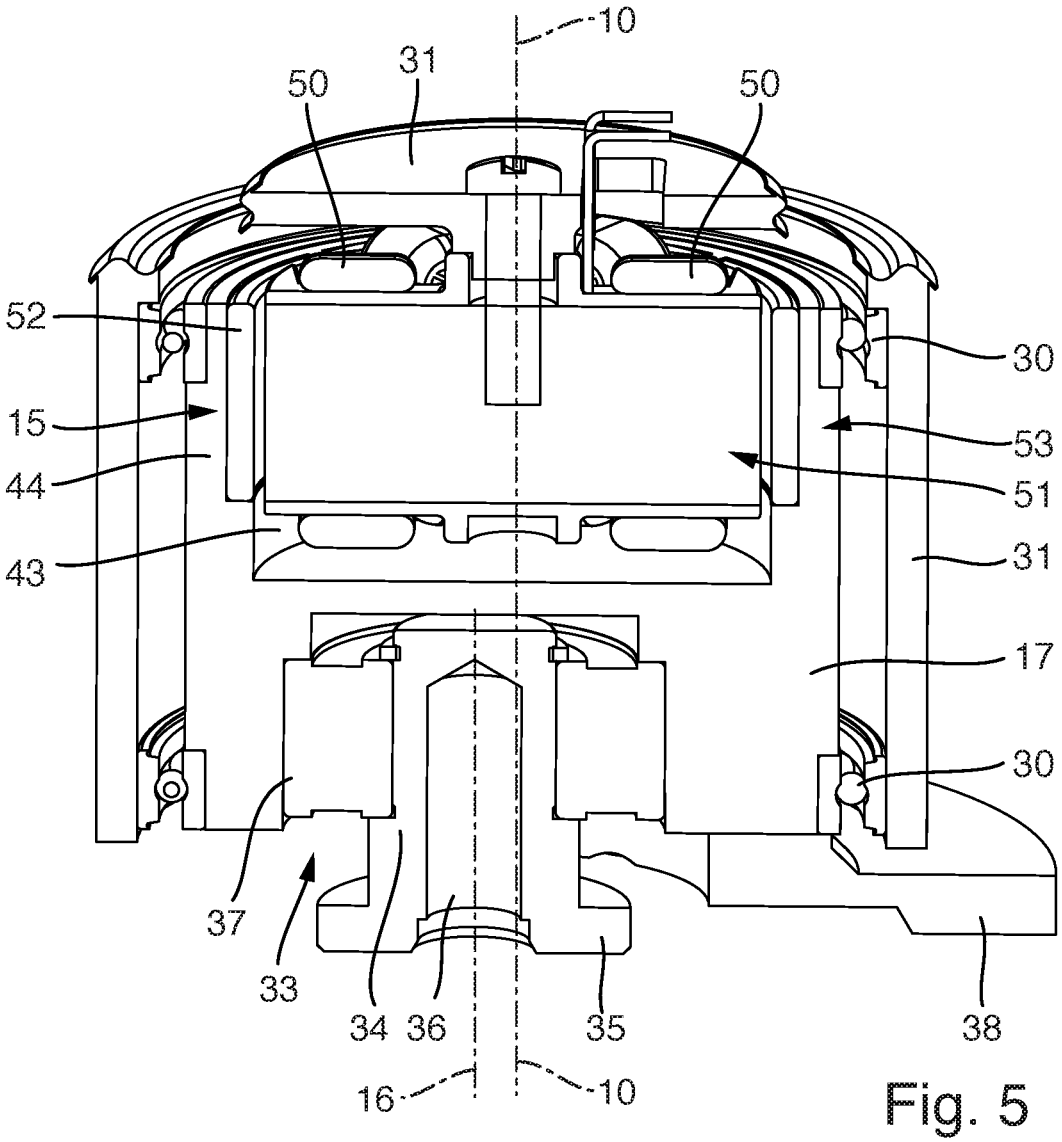
Figure 6:
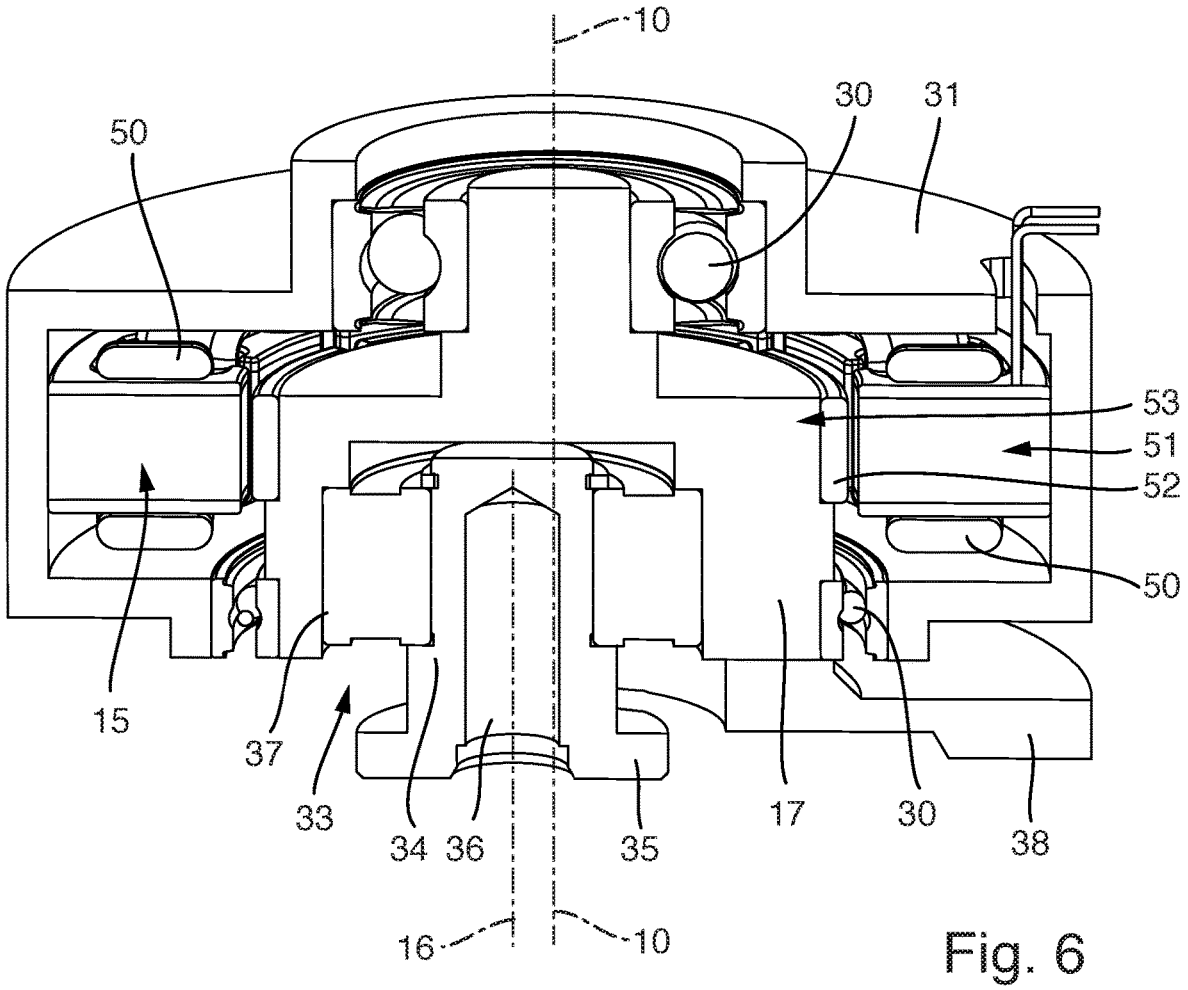
Figure 7:
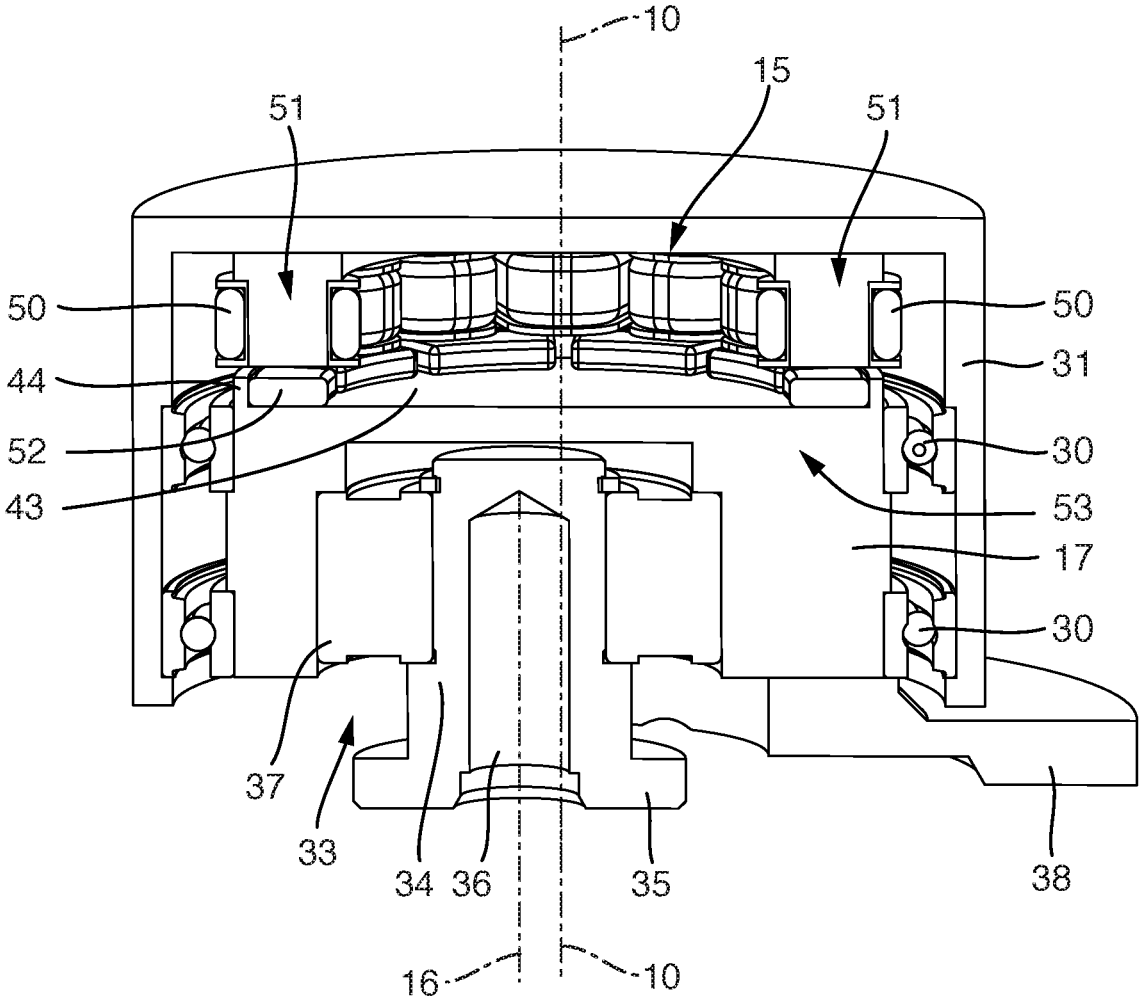
Figure 8A:
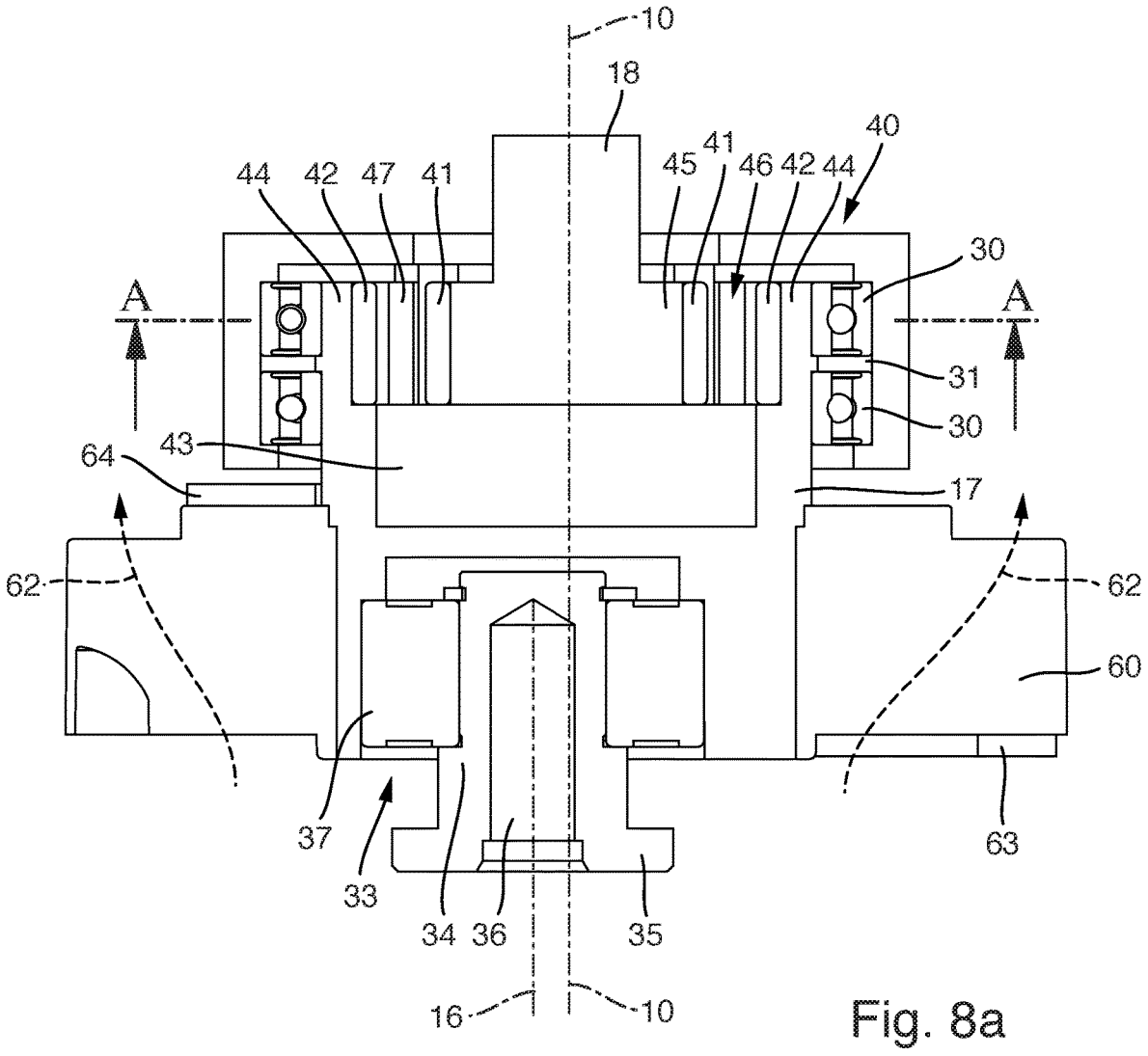
Figure 8B:
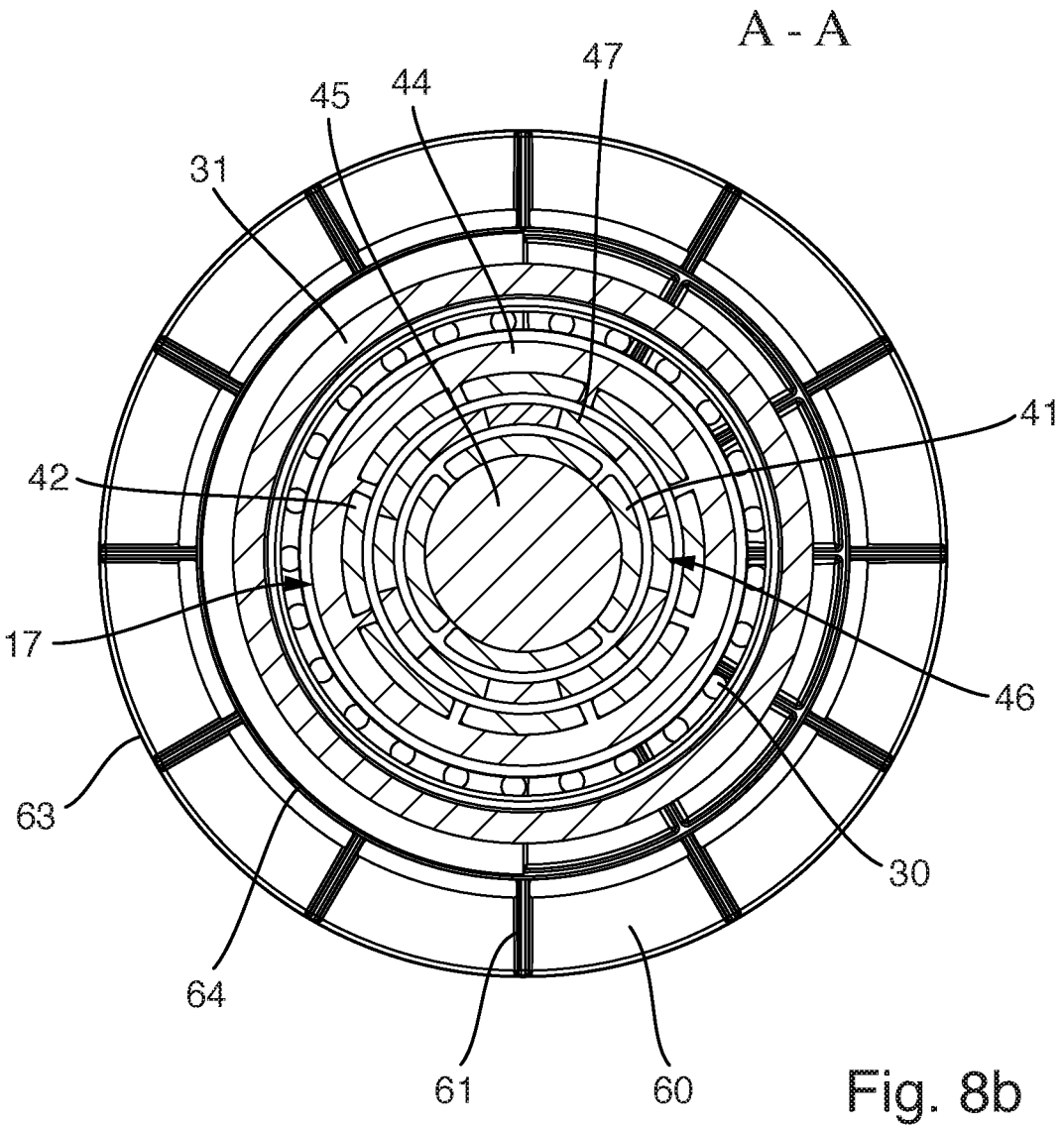
Figure 9:
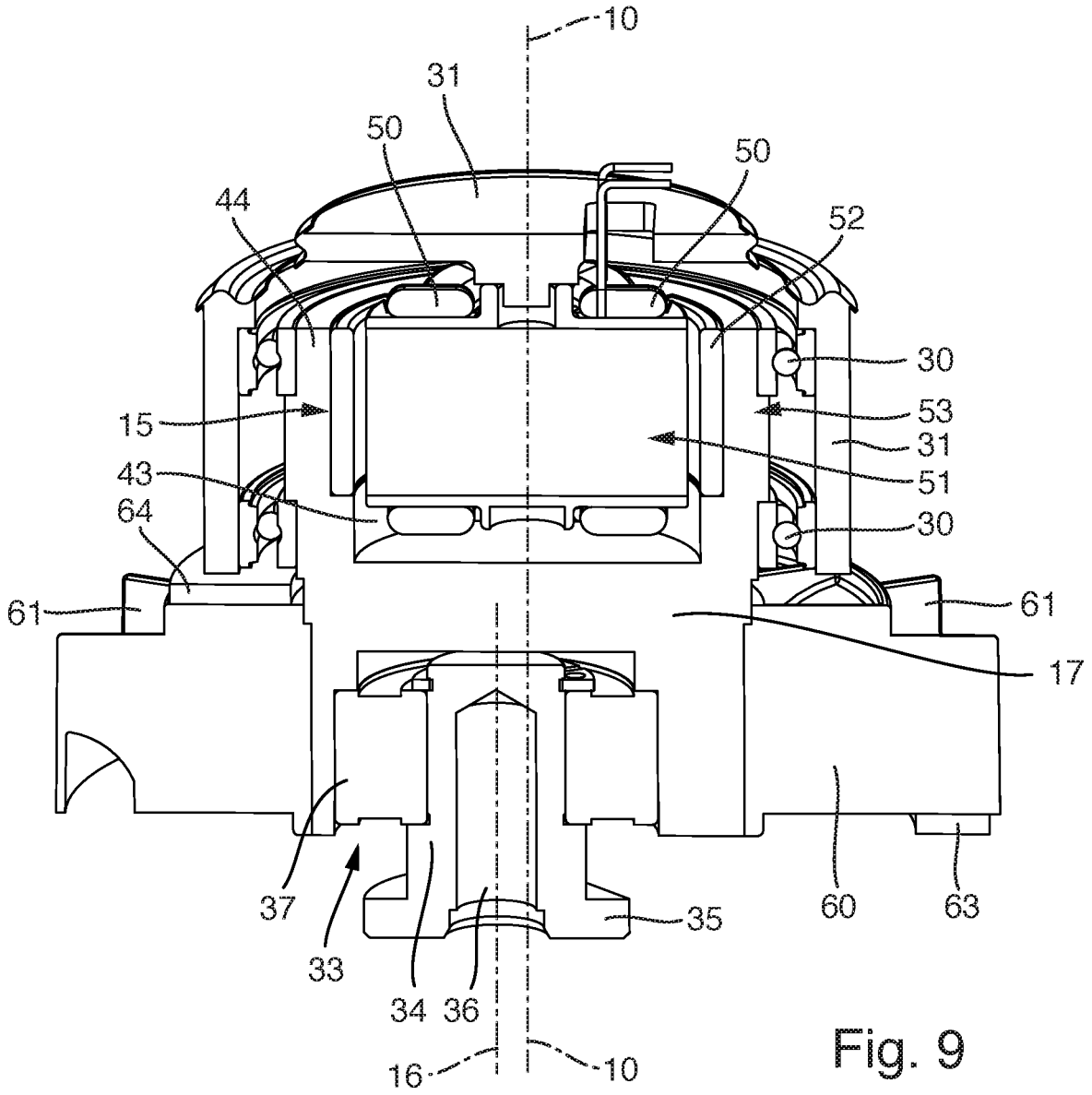
Figure 10:
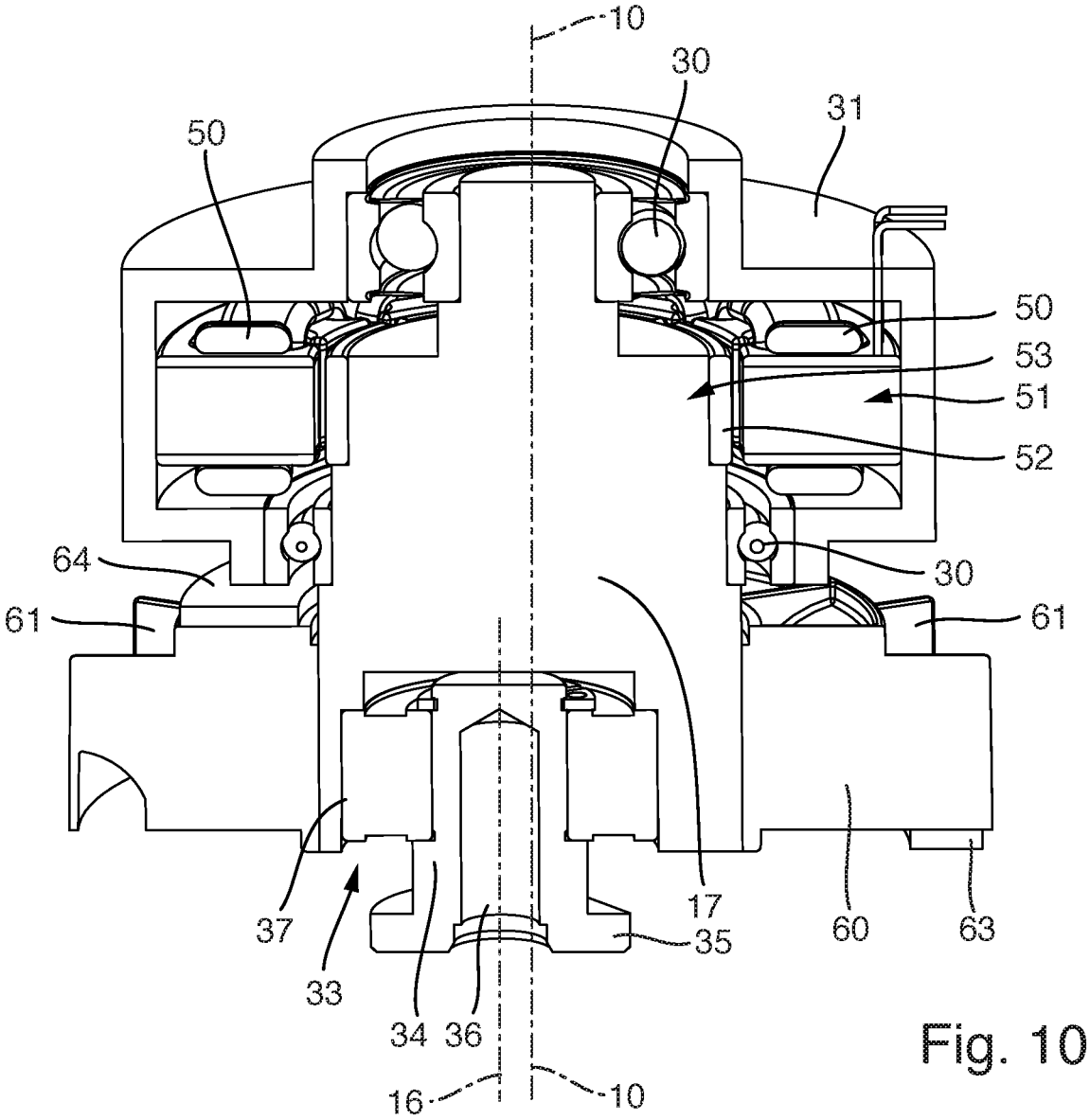
Figure 11:
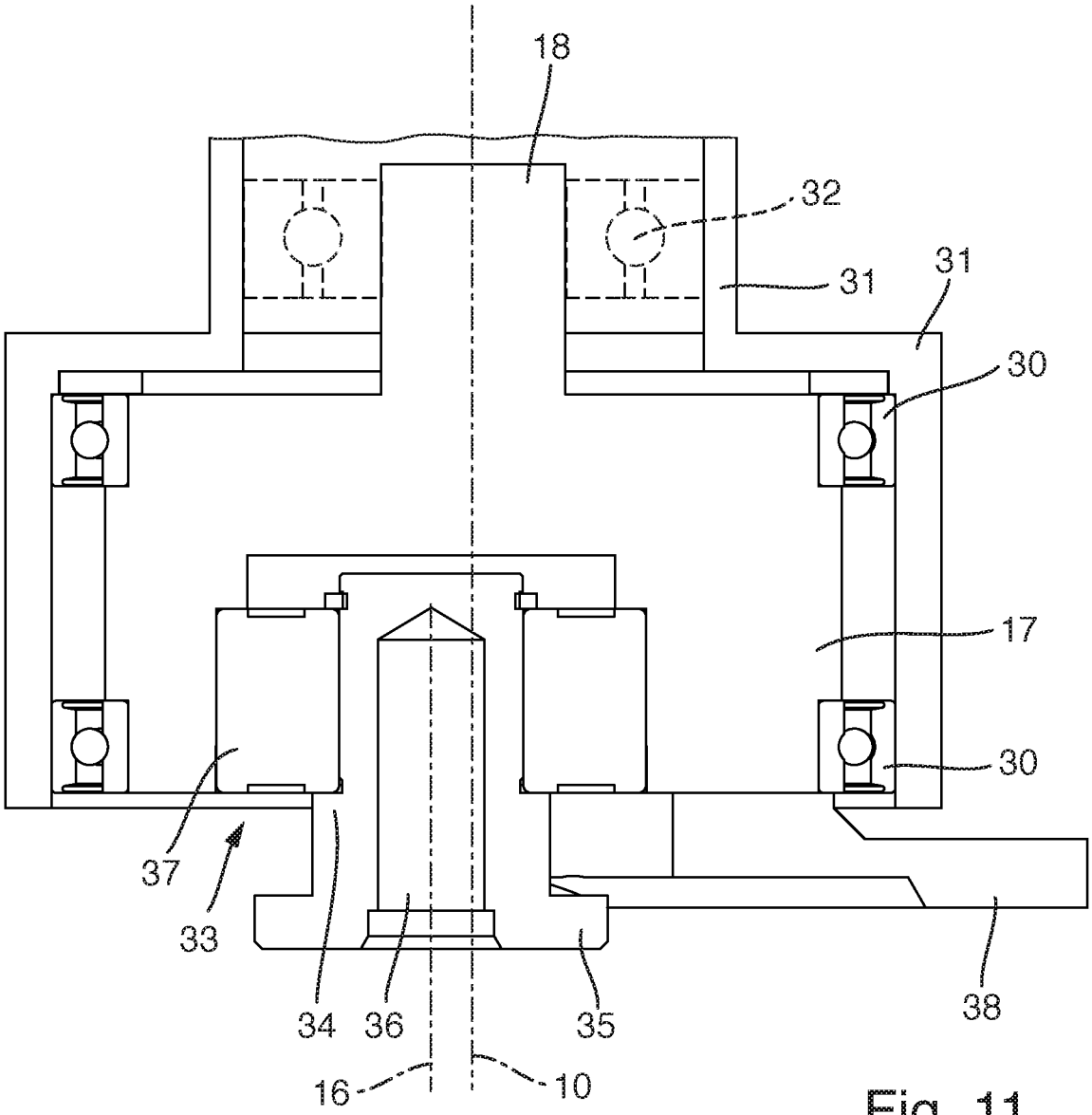
Figure 12A:
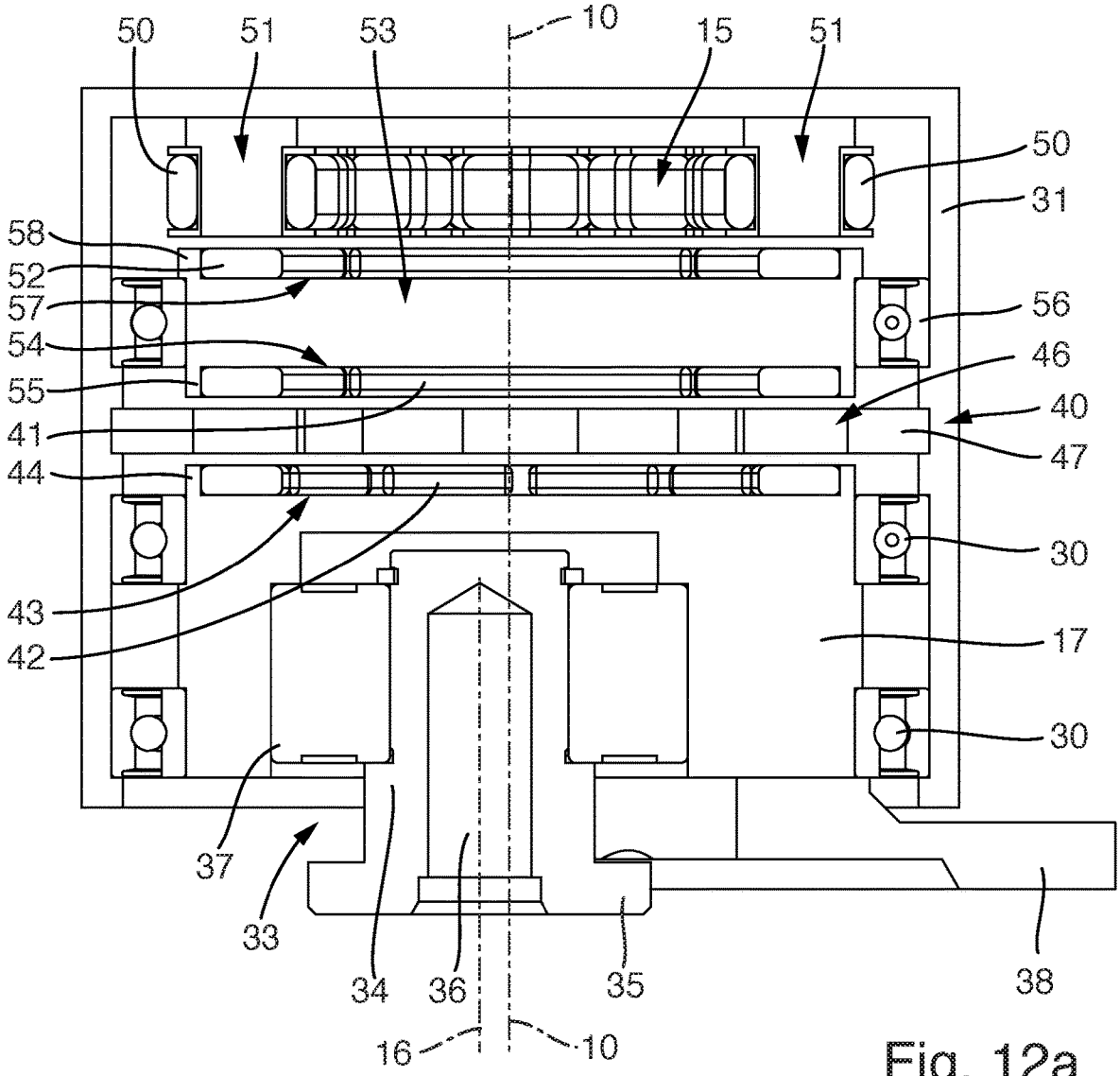
Figure 12B:
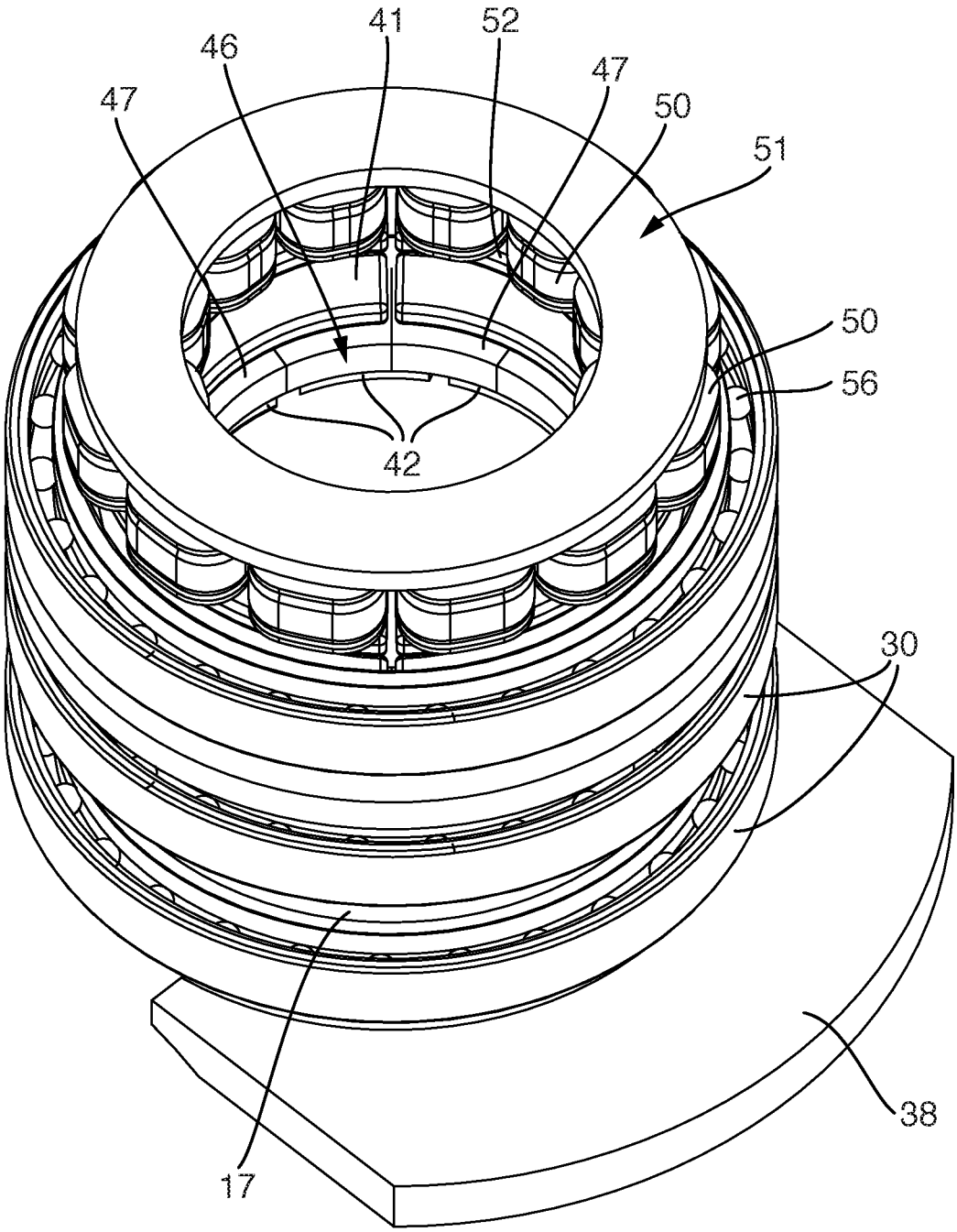
Figure 13A:
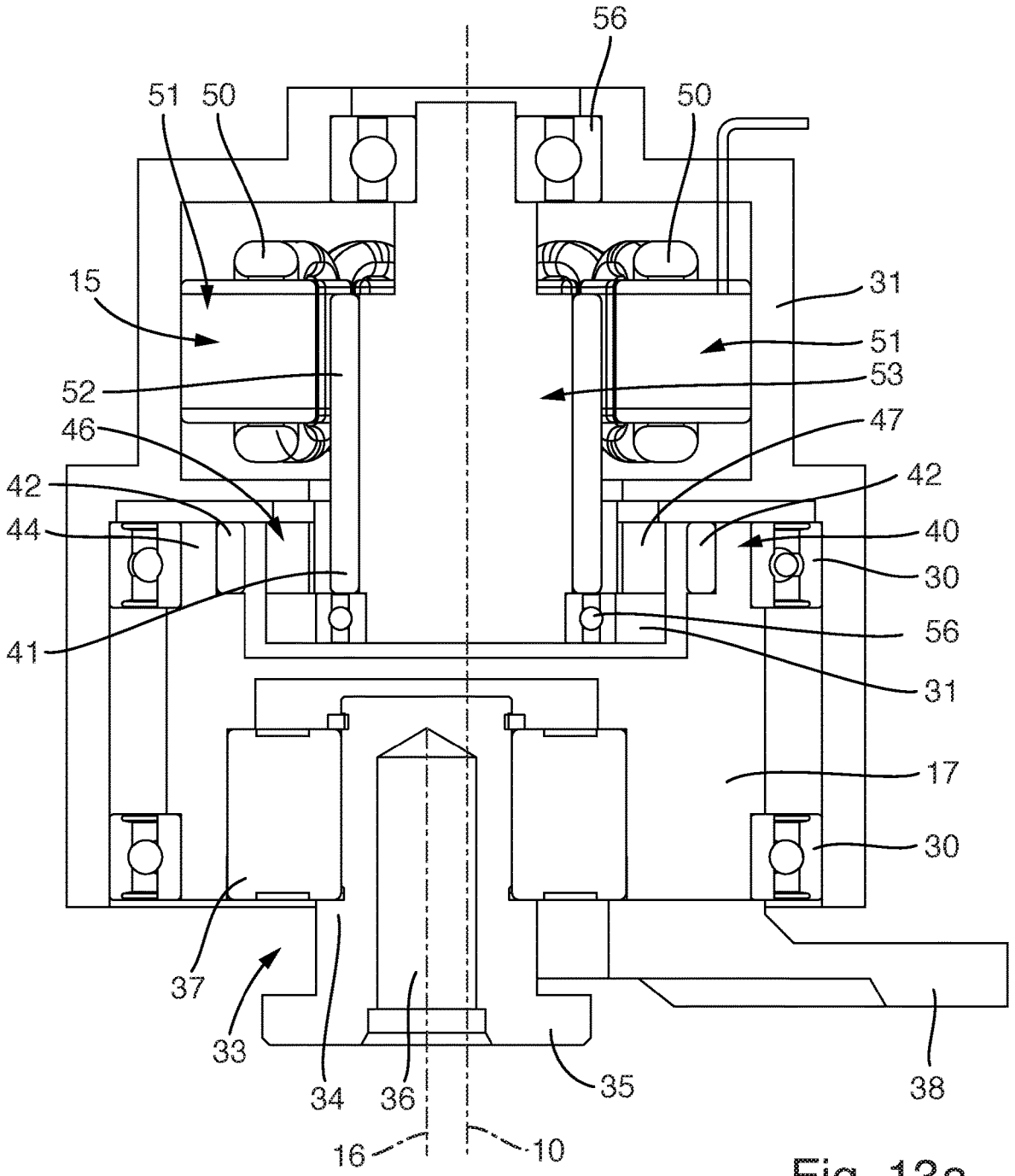
Figure 13B:
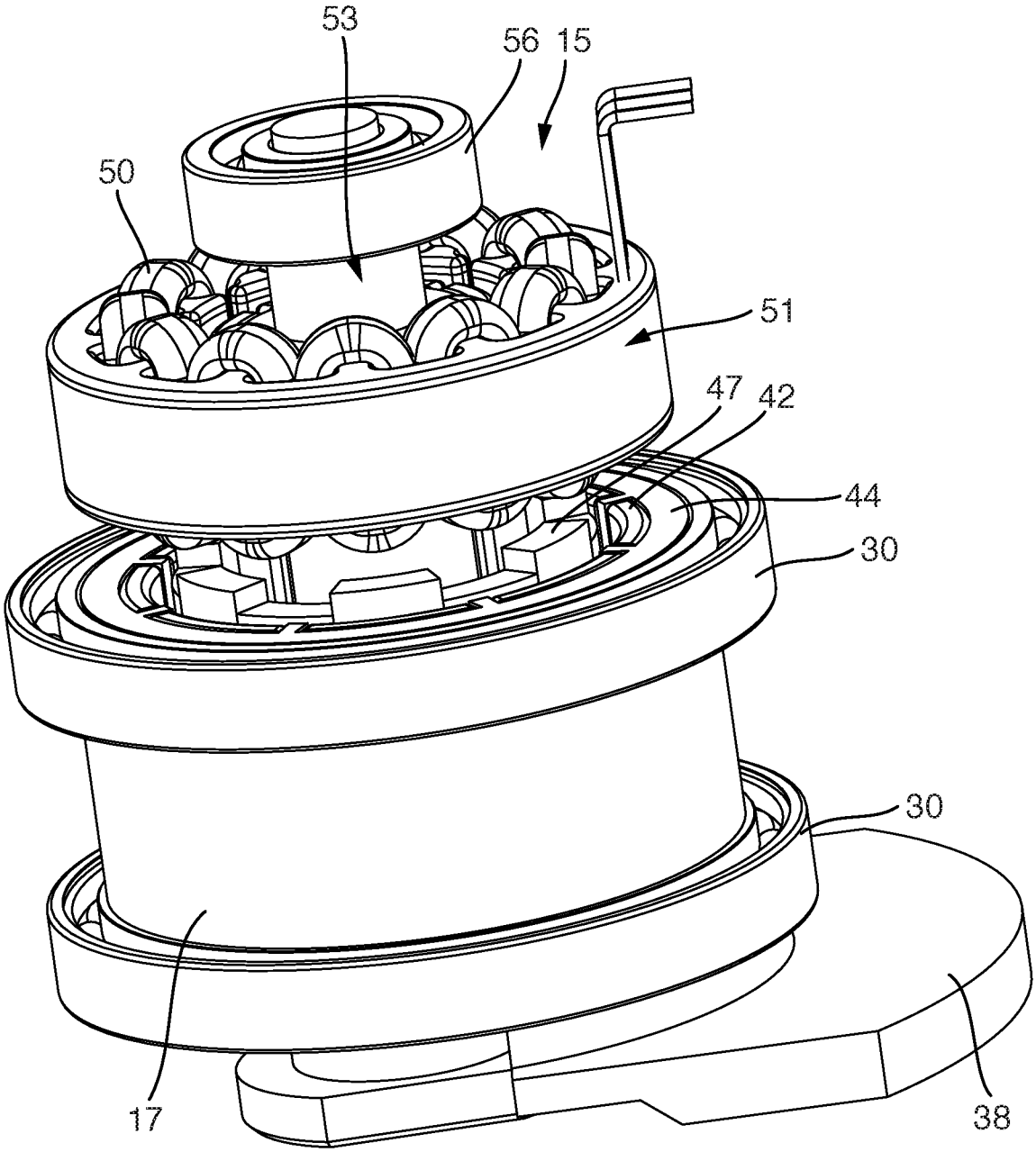
Figure 14A:
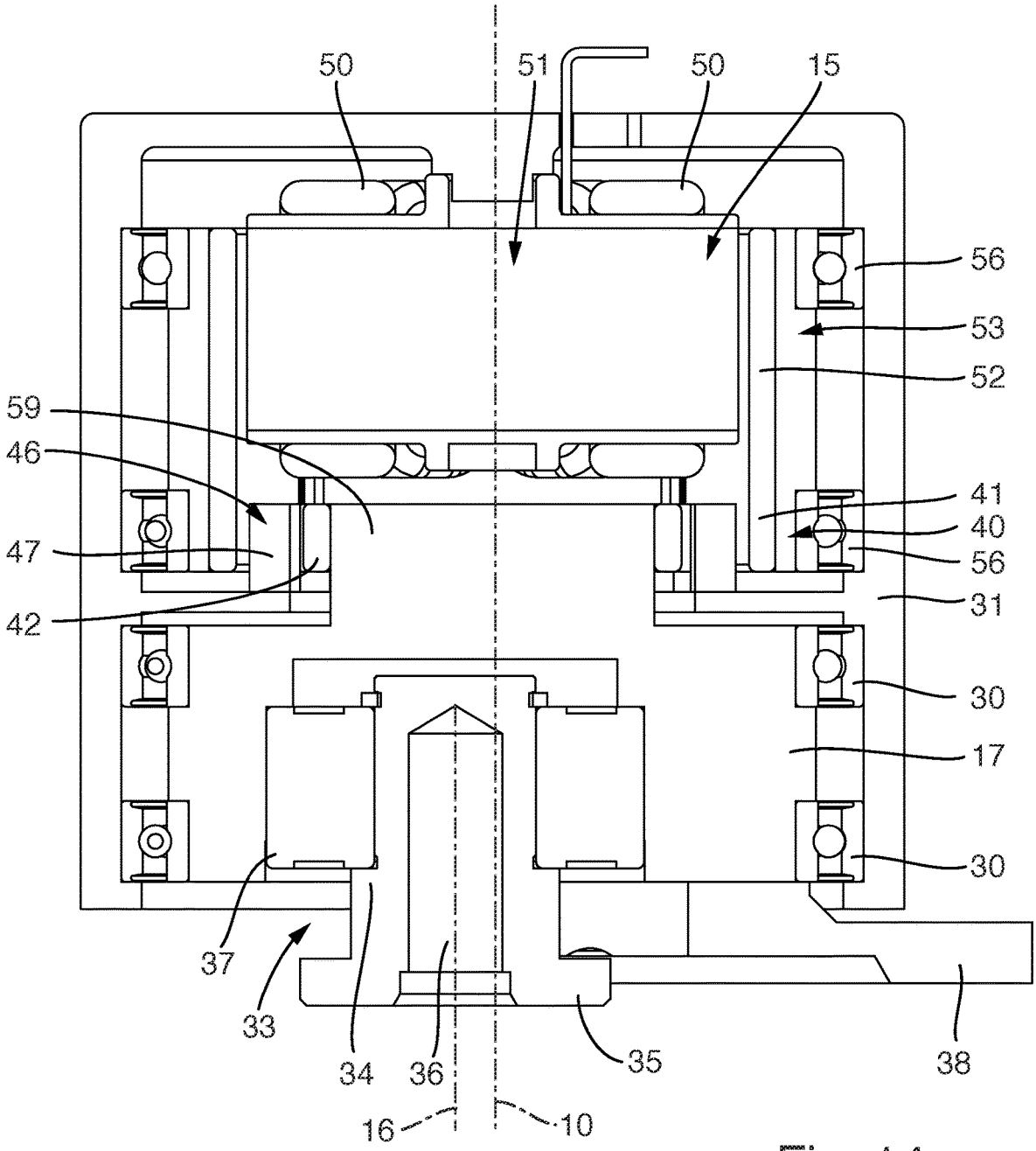
Figure 14B:
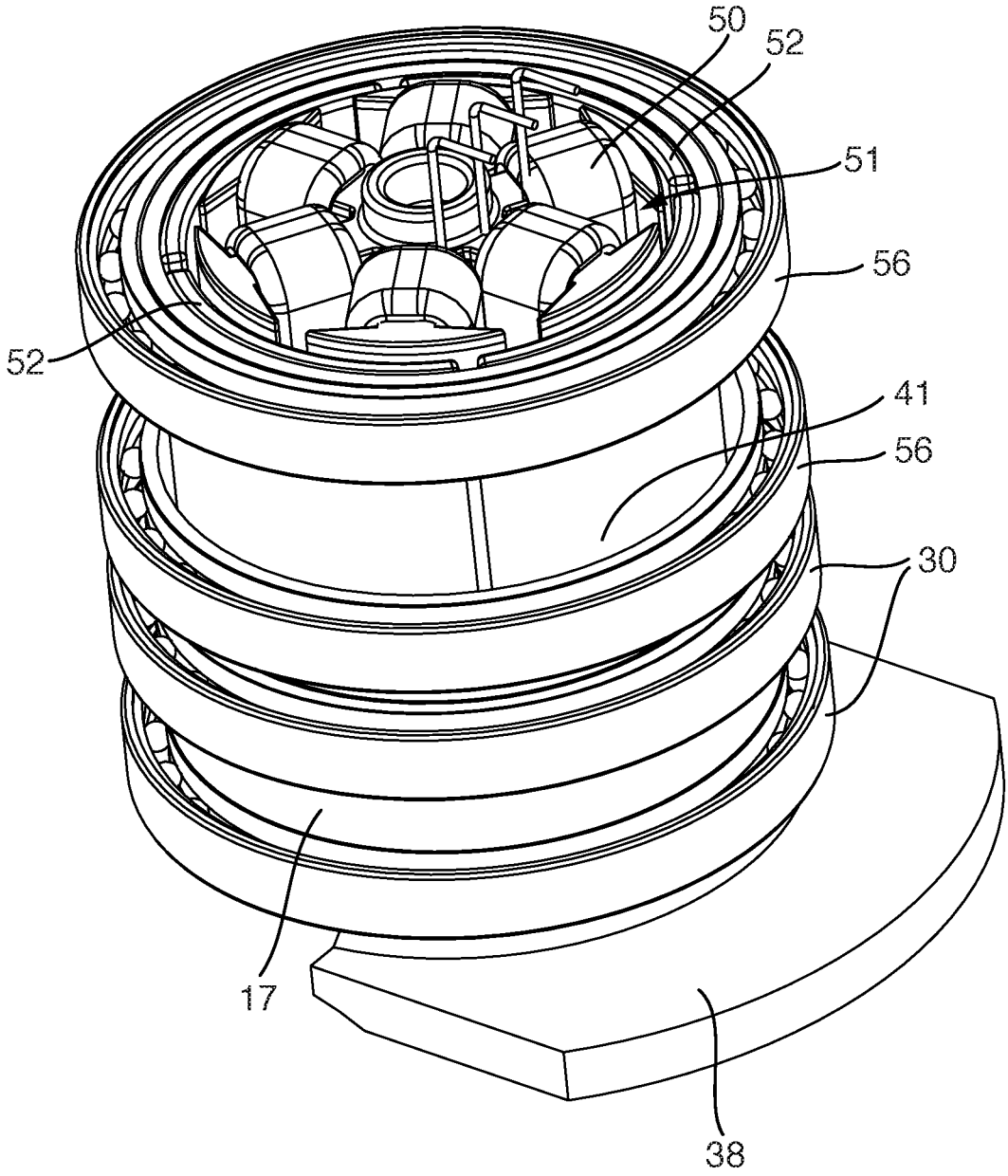
Figure 15A:
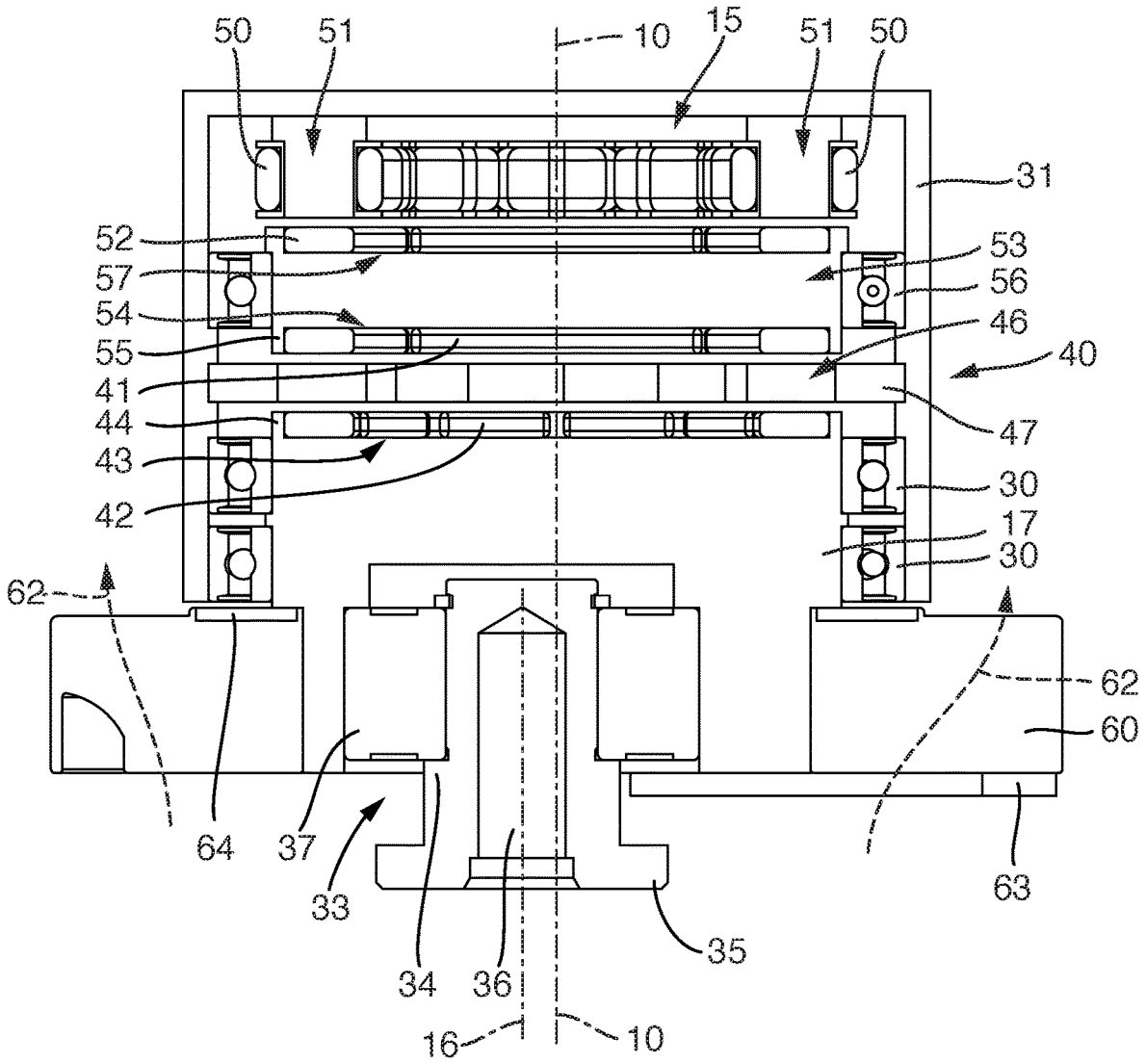
Figure 15B:
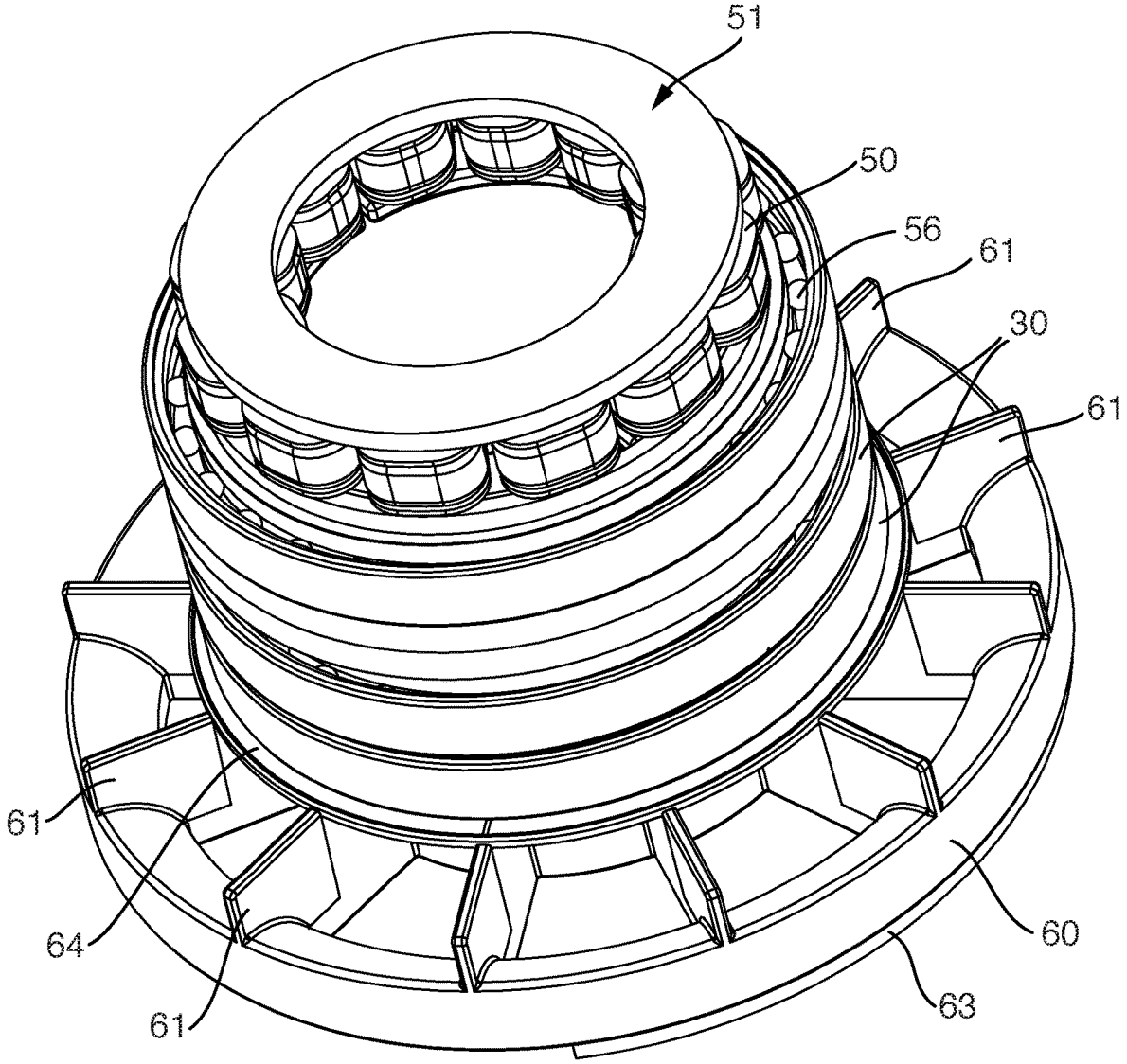
Figure 16A:
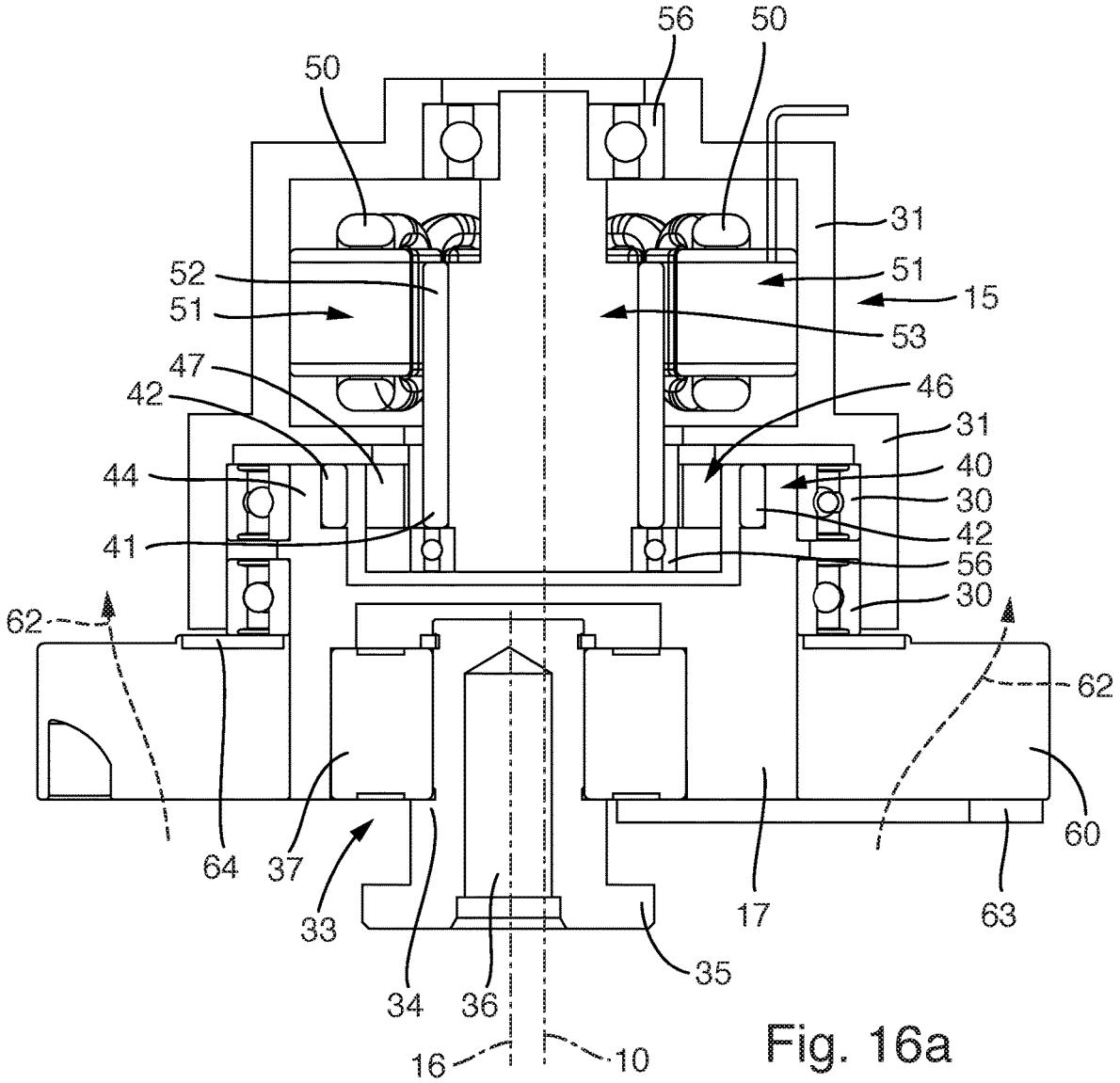
Figure 16B:
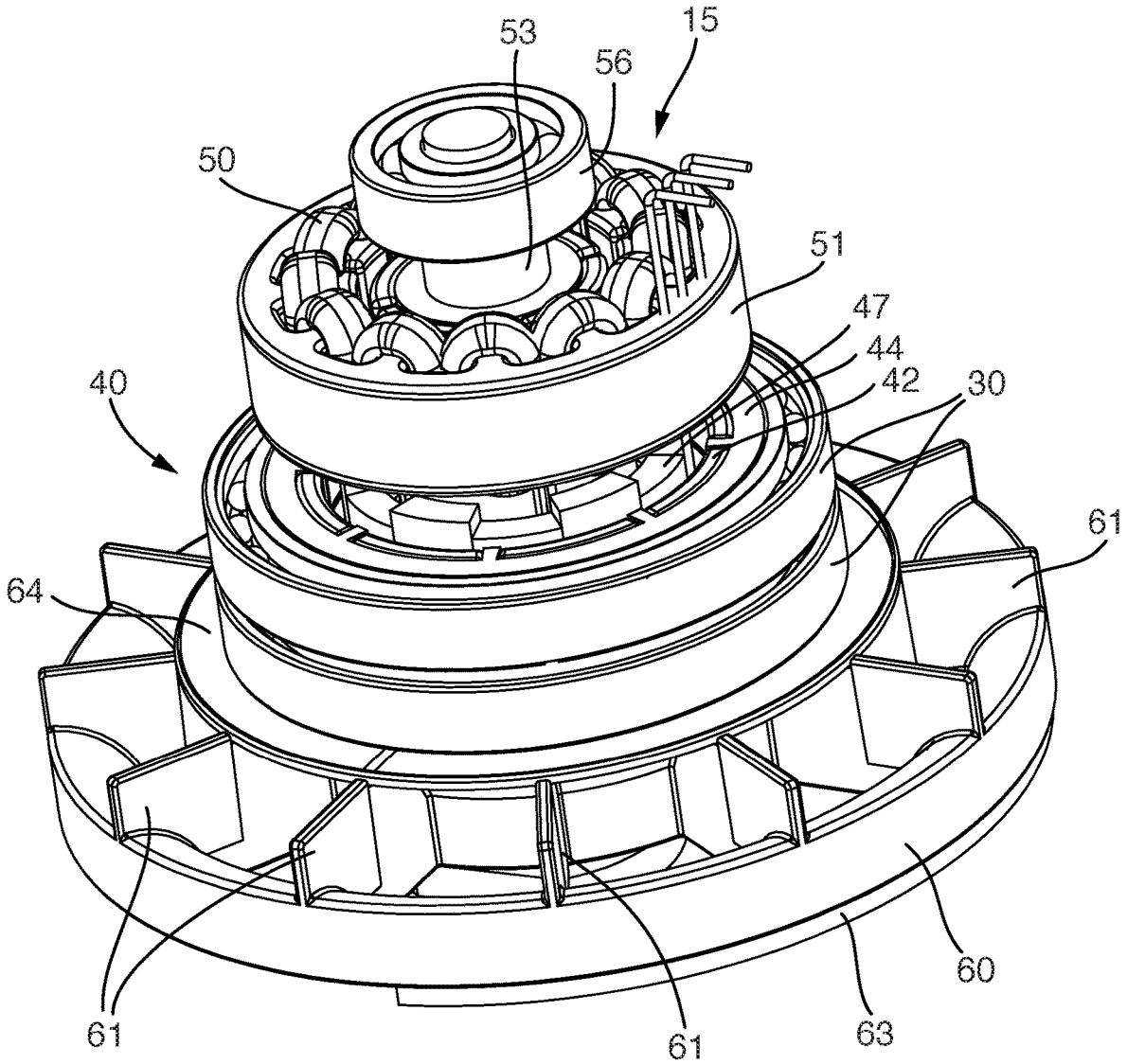
Figure 17A:
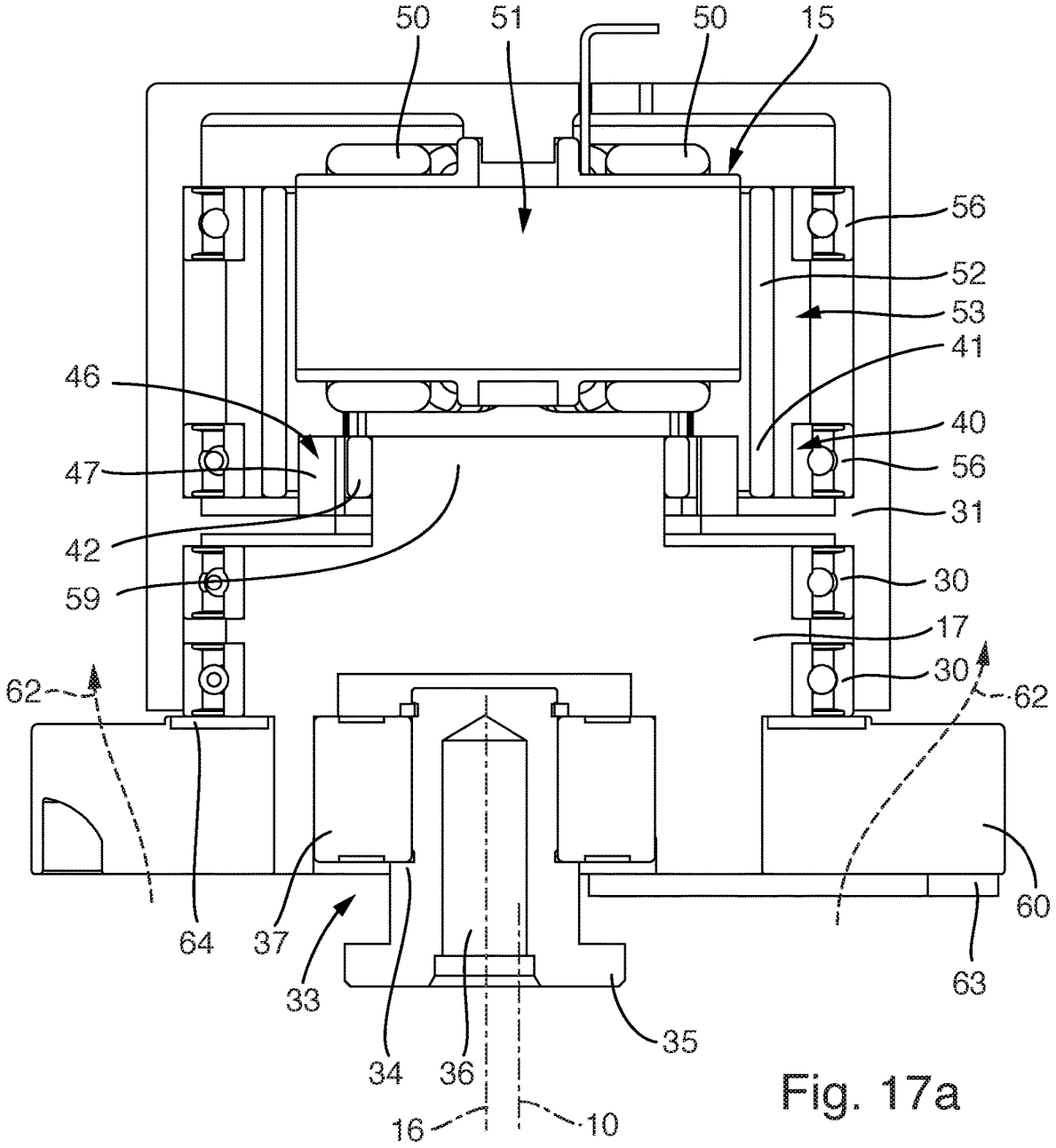
Figure 17B:
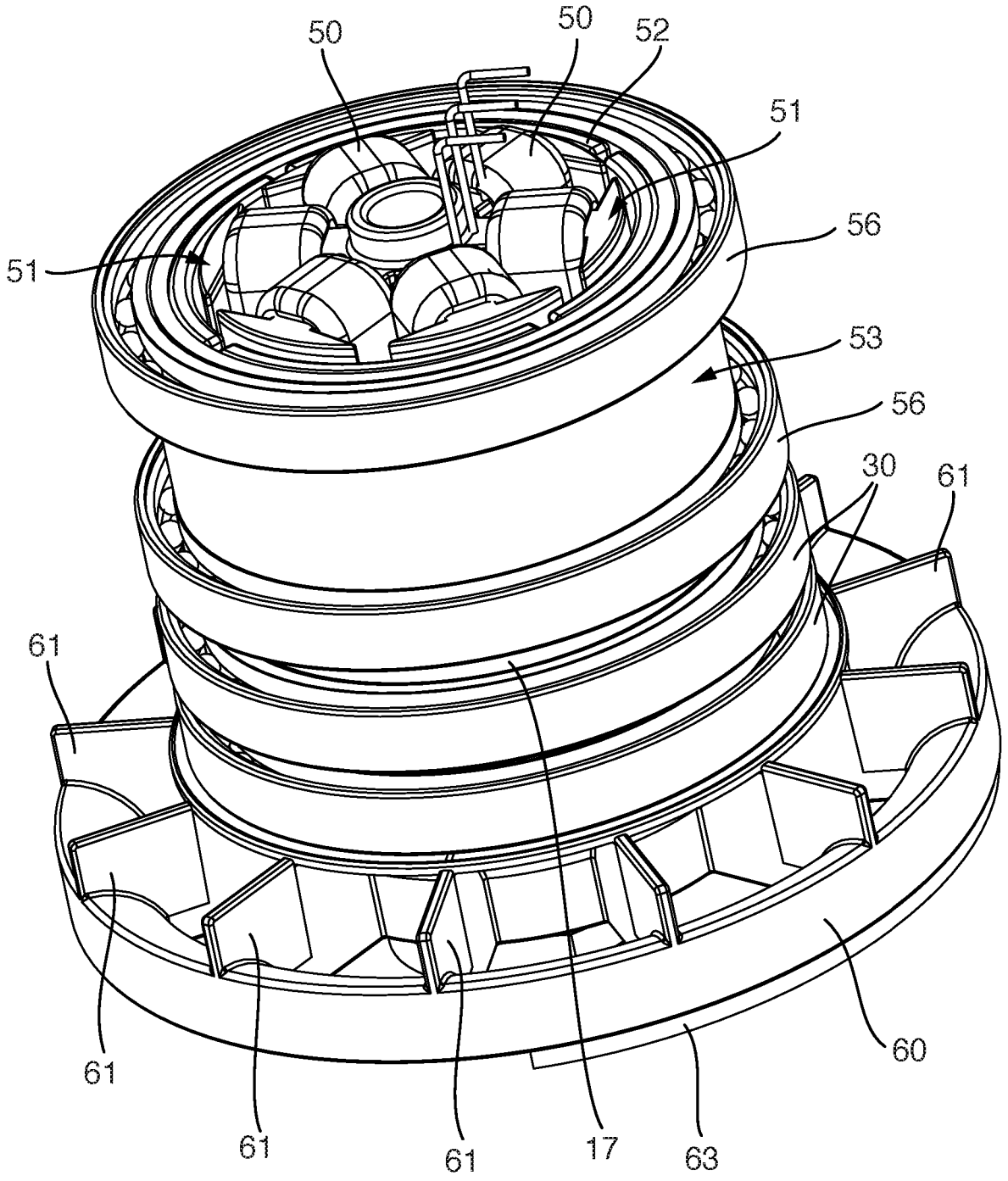

Further features and advantages of the present invention will be described in more detail with reference to the accompanying drawings. These show:

FIG. 1 an example of a hand-held and hand-guided random orbital power tool according to the present invention in a perspective view;

FIG. 2 a schematic longitudinal section through the power tool of FIG. 1;

FIG. 3*a* a vertical section through an eccentric element of the power tool of FIG. 1, comprising a magnetic transmission arrangement of a radial type and a counter weight;

FIG. 3*b* a horizontal section through the eccentric element of FIG. 3*a* along line A-A;

FIG. 4*a* a vertical section through an eccentric element of the power tool of FIG. 1, comprising a magnetic transmission arrangement of an axial type and a counter weight;

FIG. 4*b* a horizontal section through the eccentric element of FIG. 4*a* along line A-A;

FIG. 5 a vertical section through an eccentric element of the power tool of FIG. 1, comprising an electric motor of the outrunner type and a counter weight;

FIG. 6 a vertical section through an eccentric element of the power tool of FIG. 1, comprising an electric motor of the inrunner type and a counter weight;

FIG. 7 a vertical section through an eccentric element of the power tool of FIG. 1, comprising an electric motor of an axial type and a counter weight;

FIG. 8*a* a vertical section through an eccentric element of the power tool of FIG. 1, comprising a magnetic transmission arrangement of a radial type and a turbine;

FIG. 8*b* a horizontal section through the eccentric element of FIG. 8*a* along line A-A;

FIG. 9 a vertical section through an eccentric element of the power tool of FIG. 1, comprising an electric motor of the outrunner type and a turbine; and FIG. 10 a vertical section through an eccentric element of the power tool of FIG. 1, comprising an electric motor of the inrunner type and a turbine;

FIG. 11 a vertical section through an eccentric element of the power tool of FIG. 1 in a simple embodiment;

FIG. 12*a* a vertical section through an eccentric element of the power tool of FIG. 1, comprising a magnetic transmission arrangement of an axial type and an electric motor of the axial type;

FIG. 12*b* a perspective view of the eccentric element of FIG. 12*a* without a static body;

FIG. 13*a* a vertical section through an eccentric element of the power tool of FIG. 1, comprising a magnetic transmission arrangement of a radial type and an electric motor of the inrunner type;

FIG. 13*b* a perspective view of the eccentric element of FIG. 13*a* without a static body;

FIG. 14*a* a vertical section through an eccentric element of the power tool of FIG. 1, comprising a magnetic transmission arrangement of a radial type and an electric motor of the outrunner type;

FIG. 14*b* a perspective view of the eccentric element of FIG. 14*a* without a static body; and FIGS. 15*a* to 17*b* the respective embodiments of FIGS. 12*a* to 14*b*, comprising a turbine.

FIG. 1 shows an example of a hand-held and hand-guided electric power tool 1 according to the present invention in a perspective view. FIG. 2 shows a schematic longitudinal section through the power tool 1 of FIG. 1. The power tool 1 is embodied as a random orbital polishing machine (or polisher). The polisher 1 has a housing 2, essentially made of a plastic material. The housing 2 is provided with a handle 3 at its rear end and a grip 4 at its front end in order to allow a user of the tool 1 to hold the tool 1 with both hands and apply a certain amount of pressure on the grip 4 during the intended use of the tool 1. An electric power supply line 5 with an electric plug at its distal end exits the housing 2 at the rear end of the handle 3. At the bottom side of the handle 3 a switch 6 is provided for activating and deactivating the power tool 1. The switch 6 can be continuously held in its activated position by means of a push button 7. The power tool 1 can be provided with adjustment means 13 for setting the rotational speed of the tool's electric motor 15 (see FIG. 2) to a desired value. The housing 2 can be provided with cooling openings 8 for allowing heat from electronic components and/or the electric motor 15 both located inside the housing 2 to dissipate into the environment and/or for allowing cooling air from the environment to enter into the housing 2.

The power tool 1 shown in FIG. 1 has an electric motor 15. Alternatively, the power tool 1 could also have a pneumatic motor. The electric motor 15 is preferably of the brushless type. Instead of the connection of the power tool 1 to a mains power supply by means of the electric cable 5, the tool 1 could additionally or alternatively be equipped with a rechargeable or exchangeable battery (not shown) located at least partially inside the housing 2. In that case the electric energy for driving the electric motor 15 and for operating the other electronic components of the tool 1 would be provided by the battery. If despite the presence of a battery the electric cable 5 was still present, the battery could be charged with an electric current from the mains power supply before, during or after operation of the power tool 1. The presence of a battery would allow the use of an electric motor 15 which is not operated at the mains power supply voltage (230V in Europe or 110V in the US and other countries), but rather at a reduced voltage of, for example, 12V, 24V, 36V or 42V depending on the voltage provided by the battery.

The power tool 1 has a plate-like backing pad 9 rotatable about a first rotational axis 10. In particular, the backing pad 9 of the tool 1 shown in FIG. 1 performs a random orbital rotational movement 11. With the random orbital movement 11 the backing pad 9 performs a first rotational movement about the first rotational axis 10. Spaced apart from the first rotational axis 10 a second rotational axis 16 (see FIG. 2) is defined, about which the backing pad 9 is freely rotatable independently from the rotation of the backing pad 9 about the first rotational axis 10. The second axis 16 runs through the balance point of the backing pad 9 and parallel to the first rotational axis 10. The random orbital movement 11 is realized by means of an eccentric element 17 which is directly or indirectly driven by the motor 15 and performs a rotation about the first rotational axis 10. A fulcrum pin 19 is held in the eccentric element 17 and guided freely rotatable in respect to the eccentric element 17 about the second rotational axis 16. An attachment member 20 (e.g. an enlarged head portion) of the fulcrum pin 19 is inserted into a recess 22 provided in a top surface of the backing pad 9 and attached thereto in a releasable manner, e.g. by means of a screw (not shown) or by means of magnetic force. The eccentric element 17 may be directly attached to a driving shaft 18 of the power tool 1 in a torque proof manner. Alternatively, a magnetic transmission arrangement may be provided functionally between the driving shaft 18 and the eccentric element 17, thereby transmitting a rotational movement of the driving shaft 18 to the eccentric element 17 and at the same time decoupling the two components 17, 18 from one another, which will be described in more detail below.

The backing pad 9 is made of a rigid material, preferably a plastic material, which on the one hand is rigid enough to carry and support a tool accessory 12 for performing a desired work on a surface (e.g. polishing or sanding the surface of a vehicle body, a boat or aircraft hull) during the intended use of the power tool 1 and to apply a force to the backing pad 9 and the tool accessory 12 in a direction downwards and essentially parallel to the first rotational axis 10 and which on the other hand is flexible enough to avoid damage or scratching of the surface to be worked by the backing pad 9 or the tool accessory 12, respectively. For example, in the case where the power tool 1 is a polisher, the tool accessory 12 may be a polishing material comprising but not limited to a foam or sponge pad, a microfiber pad, and a real or synthetic lambs' wool pad. In FIG. 1 the tool accessory 12 is embodied as a foam or sponge pad. In the case where the power tool one is a sander, the tool accessory 12 may be a sanding or grinding material comprising but not limited to a sanding paper, and a sanding textile. The backing pad 9 and the tool accessory 12, respectively, preferably have a circular form.

The bottom surface of the backing pad 9 is provided with means for releasably attaching the tool accessory 12 thereto. The attachment means can comprise a first layer of a hook-and-loop fastener (or Velcro®) on the bottom surface of the backing pad 9, wherein the top surface of the tool accessory 12 is provided with a corresponding second layer of the hook-and-loop fastener. The two layers of the hook-and-loop fastener may interact with one another in order to releasably but safely fix the tool accessory 12 to the bottom surface of the backing pad 9. Of course, with other types of power tools 1, the backing pad 9 and the tool accessory 12 may be embodied differently.

Now turning to the inside of the power tool 1 shown in FIG. 2, it can be seen that the electric motor 15 does not directly drive the driving shaft 18. Rather, a motor shaft 23 of the motor 15 constitutes an input shaft for a bevel gear arrangement 21. An output shaft of the bevel gear arrangement 21 constitutes the driving shaft 18. The bevel gear arrangement 21 serves for translating a rotational movement of the motor shaft 23 about a longitudinal axis 24 into a rotational movement of the driving shaft 18 about the first rotational axis 10. The rotational speeds of the motor shaft 23 and of the driving shaft 18 may be the same (the bevel gear arrangement 21 has a gear ratio of 1) or defer from one another (the bevel gear arrangement 21 has a gear ratio $\neq 1$). The bevel gear arrangement 21 is necessary because the shown power tool 1 is an angular polisher, where the longitudinal axis 24 of the motor shaft 23 runs in a certain angle $\alpha$ (preferably between 90° and below 180°) in respect to the first rotational axis 10 of the driving shaft 18. In the shown embodiment the angle is exactly 90°. Of course, in other power tools 1 it could well be possible that the two axes 24, 10 are identical and, therefore, that there is no need for a bevel gear arrangement 21.

The present invention in particular refers to a special design of the eccentric element 17. In the prior art, the eccentric element 17 is fixedly attached to the drive shaft 18 in a torque proof manner. The driving shaft 18 is guided by one or more bearings in respect to a static body of the power tool 1. The static body may be fixed to the housing 2 of the power tool 1 or could be the housing 2 itself. The bearings allow a rotation of the driving shaft 18 about the first rotational axis 10. The eccentric element 17 has no separate bearings. During rotation about the first rotational axis 10 the eccentric element 17 is only guided by the bearings assigned to the driving shaft 18. In this conventional construction of the known power tools 1 the eccentric element 17 is spaced apart rather far from the bearings assigned to the driving shaft 18. Due to the rather high weight of the eccentric element 17 (including the backing pad 9, the tool accessory 12 and a counter weight connected thereto) in combination with the eccentric movement about the first rotational axis 10 at rather high speeds (up to 12,000 rpm), there are considerable lateral forces exerting on the eccentric element 17 and moments exerted on the driving shaft 18 to which it is attached. This may cause considerable vibrations and leads to a rather high mechanical load exerted on the driving shaft 18 and the bearings guiding it.

These drawbacks are overcome by the power tool 1 according to the present invention and its special eccentric element 17. A simple embodiment of the eccentric element 17 according to the invention is shown in FIG. 11. Various more sophisticated embodiments of the eccentric element 17 are shown in FIGS. 3 to 10 and explained in more detail below. According to the invention it is suggested that at least part of an external circumferential surface of the eccentric element 17 has an at least discrete rotational symmetry in respect to the first rotational axis 10; and that the power tool 1 comprises at least one first bearing 30 provided between the rotationally symmetric part of the external circumferential surface of the eccentric element 17 and the static body 31 of the power tool 1 so that the eccentric element 17 is guided in respect to the body 31 in a manner rotatable about the first rotational axis 10. This embodiment is shown in FIG. 11.

The main idea of the present invention is to provide the eccentric element 17 of a random orbital power tool 1 with at least one separate bearing 30 for directly guiding the eccentric element 17 during its rotation about the first rotational axis 10. The bearing 30 can absorb the lateral forces directly from the rotating eccentric element 17 (including the backing pad 9, the tool accessory 12 and a counter weight connected thereto). This has the advantage that vibrations of the power tool 1 during its operation resulting from the eccentric element 17 (including the backing pad 9, the tool accessory 12 and a counter weight connected thereto) at high speeds (up to 12,000 rpm) can be significantly reduced. Preferably, the eccentric element 17 is provided with at least two bearings 30 spaced apart from each other in the direction of the first rotational axis 10, in particular located at opposite ends of the eccentric element 17 along the first rotational axis 10. The bearings 30 are preferably an annular ball race. In particular, it is suggested that the two bearings 30 are inclined support bearings configured as an O-arrangement. This can increase the effective distance between two bearings 30 and allows absorption of larger tilting moments.

In case the eccentric element 17 is fixedly attached to or forms an integral part of the driving shaft 18 (see FIG. 11), the eccentric element 17 could be provided with only one first bearing 30 located at a bottom end of the eccentric element 17 opposite to the driving shaft 18. In that case the first bearing 30 located at an upper end of the eccentric element 17 directed towards the driving shaft 18 could be omitted. Instead, a further bearing 32 (drawn with dashed lines in FIG. 11) could be assigned to the driving shaft 18, which can further increase the effective distance between the two support bearings 30, 32 and allows absorption of even larger tilting moments.

In order to allow a direct guiding of the eccentric element 17 by means of the bearings 30, at least that part of the external circumferential surface of the eccentric element 17, where the bearings 30 are provided, has an at least discrete rotational symmetry in respect to the first rotational axis. Preferably, the rotationally symmetric part of the external circumferential surface of the eccentric element 17 has a rotational symmetry in respect to a rotation about the first rotational axis 10 by any angle (so-called circular symmetry). This means that the rotationally symmetric part of the external circumferential surface of the eccentric element 17 has a cylindrical form, wherein the cylinder axis corresponds to the first rotational axis 10 of the eccentric element 17. The bearings 30 are provided on the cylindrical part of the eccentric element 17 and guides the eccentric element 17 in respect to the static body 31 (e.g. the housing or a separate chassis attached to the housing) of the power tool 1.

The eccentric element 17 comprises an eccentric seat 33 where a fulcrum pin 34 is inserted and guided in a freely rotatable manner about the second rotational axis 16. The fulcrum pin 34 comprises attachment means 35, e.g. an enlarged head portion, to which the backing pad 9 may be releasably attached. To this end, a recess is provided on a top surface of the backing pad 9, wherein the internal circumferential form of the recess corresponds to the external circumferential form of the attachment means 35. The fulcrum pin 34 has a threaded bore 36, into which a screw can be screwed after insertion of the attachment means 35 into the recess of the backing pad 9, thereby releasably fixing the backing pad 9 to the fulcrum pin 34. Preferably, the eccentric element 17 comprises at least one second bearing 37 at the eccentric seat 33 and provided between the eccentric element 17 and the fulcrum pin 34 so that the fulcrum pin 34 is guided in respect to the eccentric element 17 in a freely rotatable manner about the second rotational axis 16.

At least one of the first bearings 30 is preferably located on the rotationally symmetric part of the external circumferential surface of the eccentric element 17 in such a manner that it surrounds at least part of the eccentric seat 33 and the second bearing 37, respectively. With other words, the first bearing 30 located towards the bottom of the eccentric element 17 and the second bearing 37 are located in the same horizontal plane. This provides for a particularly good and effective absorption of the lateral forces introduced into the eccentric element 17 by the backing pad 9 through the fulcrum pin 34, which is guided in the second bearing 37. A separate counterweight 38 is provided on a side of the first rotational axis 10 opposite to the second rotational axis 16, The counterweight 38 may be an integral part of the eccentric element 17. Preferably, the counterweight 38 is a part separate from the eccentric element 17 and attached thereto, for example, by means of one or more screws.

According to a more sophisticated embodiment shown in FIGS. 3*a* and 3*b*, the power tool 1 comprises a magnetic transmission arrangement 40 provided functionally between the driving shaft 18 and the eccentric element 17. The transmission arrangement 40 comprises a first number of first permanent magnets 41 attached to a circumferential outer surface of the driving shaft 18 with alternating polarities, and a second number of second permanent magnets 42 attached to a circumferential inner surface of the eccentric element 17 with alternating polarities and opposite to the first permanent magnets 41. In the shown embodiment, the eccentric element 17 comprises a recessed portion 43 on its top surface leaving a circumferential edge portion 44. The driving shaft 18 comprises a laterally protruding, preferably disk-shaped end section 45 which is located in the recessed portion 43. The first permanent magnets 41 are attached to the outer circumferential surface of the end section 45 and the second permanent magnets 42 are attached to the inner circumferential surface of the edge portion 44. The magnetic transmission arrangement 40 decouples the eccentric element 17 from the driving shaft 18 and possible vibrations of the eccentric element 17 during operation of the power tool 1 are no longer transmitted to the driving shaft 18 and the rest of the power tool 1, respectively. The magnetic transmission arrangement 40 of this embodiment is of a radial type with the magnetic field between the first permanent magnets 41 and the second permanent magnets 42 extending in an essentially radial direction.

The magnetic transmission arrangement 40 may simply provide for a decoupling effect and torque transmission between the driving shaft 18 and the eccentric element 17, making the eccentric element 17 rotate at the same speed as the driving shaft 18 (gear ratio of 1). Alternatively, the transmission arrangement 40 can also have the characteristic of a gear mechanism with a gear ratio ≠1. In particular, it is suggested that the magnetic transmission arrangement 40 has a gear ratio of >1, which means that the output (eccentric element 17) rotates at a lower speed about the first rotational axis 10 than the input (driving shaft 18), thereby increasing the torque at the eccentric element 17 and, consequently, at the backing pad 9. A gear ratio of 1 can be achieved by providing the same number of first permanent magnets 41 and second permanent magnets 42 on the driving shaft 18 and the eccentric element 17, respectively. A gear ratio ≠1 can be achieved by providing a different number of first permanent magnets 41 and second permanent magnets 42 on the respective parts. In the shown embodiment, there are two pole pairs of first permanent magnets 41 and four pole pairs of second permanent magnets 42. The magnetic transmission arrangement 40 further comprises a modulator 46 with a third number of segments 47 made of ferromagnetic material, e.g. steel, which are attached to the static body 31 of the power tool 1. The ferromagnetic segments 47 are located between the first permanent magnets 41 and the second permanent magnets 42. The modulator 46 alters the magnetic field and optimises the magnetic flux between the first permanent magnets 41 and the second permanent magnets 42. In the embodiment shown in FIGS. 3*a*, 3*b* there are six pairs of ferromagnetic elements 47. Of course, different numbers of first and second permanent magnets 41, 42 and/or of ferromagnetic segments 47 can be used.

Alternatively, the magnetic transmission arrangement 40 may be of an axial type (see FIGS. 4*a* and 4*b*) with the magnetic field between the first permanent magnets 41 and the second permanent magnets 42 extending in an essentially axial direction, that is essentially parallel to the rotational axes 10, 16. The first number of first permanent magnets 41 are attached to the driving shaft 18 with alternating polarities facing the top surface of the eccentric element 17. The disk-shaped end section 45 has a diameter similar to the diameter of the eccentric element 17. The first permanent magnets 41 are attached to a bottom surface of the disk-shaped end section 45. The second number of second permanent magnets 42 is attached to the top surface of the eccentric element 17 with alternating polarities and opposite to the first permanent magnets 41. In particular, the second permanent magnets 42 are received in the recessed portion 43 in the top surface of the eccentric element 17.

According to another embodiment of the present invention shown in FIG. 5, the motor 15 of the power tool 1 is an electric motor with electric windings 50 of a stator 51 of the motor 15 attached to the body 31 of the power tool 1 and permanent magnets 52 of a rotor 53 of the motor 15 attached to the eccentric element 17. Hence, the rotor 53 is constituted by part of the eccentric element 17. The electric motor 15 is integrated into the eccentric element 17 allowing the construction of a comparatively flat integral unit comprising the electric motor 15 and the eccentric element 17. Consequently, also the housing 2 of the power tool 1 containing the integral unit 15, 17 can be provided much flatter than before. In the shown embodiment, the electric motor 15 is of a radial type with the magnetic field between the electric stator windings 50 and the permanent magnets 52 of the rotor 53 extending in an essentially radial direction. In the case of an electric motor 15 of the radial type, a distinction can be made between two types of construction, a so-called outrunner and a so-called inrunner.

The outrunner type is shown in FIG. 5. The electric stator windings 50 are located between the first rotational axis 10 of the eccentric element 17 and a part of the external eccentric element 17 to which the permanent magnets 52 are attached. In particular, the electric stator windings 50 of the motor 15 are located in the central recessed portion 43 provided in the end face of the eccentric element 17 opposite to the eccentric seat 33. The permanent magnets 52 are fixedly attached to an inner circumferential surface of the edge portion 44 with alternating polarities.

The inrunner type is shown in FIG. 6. A part of the eccentric element 17, to which the permanent magnets 52 are attached, is located between the first rotational axis 10 of the eccentric element 17 and the external electric stator windings 50. In particular, the electric stator windings 50 surround circumferentially at least part of the eccentric element 17. The permanent magnets 52 are fixedly attached to an outer circumferential surface of that part of the eccentric element 17, which is surrounded by the electric stator windings 50.

The electric motor 15 could also be of an axial type, as is shown in FIG. 7, with the magnetic field between the electric stator windings 50 and the permanent magnets 52 of the rotor 53 extending in an essentially axial direction, that is essentially parallel to the rotational axes 10, 16. To this end it is suggested that the stator windings 50 are located circumferentially around the first rotational axis 10 of the eccentric element 17 facing the top surface of the eccentric element 17. The top surface is the side of the eccentric element 17 opposite to that side of the eccentric element 17 where the eccentric seat 33 is provided and to which the backing pad 9 is connected. The stator windings 50 are oriented in such a manner that a magnetic flux generated by the stator windings 50 is directed axially. The permanent magnets 52 of the rotor 53 are attached to an end face of the eccentric element 15 facing the stator windings 50 and located circumferentially around the first rotational axis 10 of the eccentric element 17. In particular, the permanent magnets 52 are located in the recessed portion 43 of the top surface of the eccentric element 17, laterally supported by the circumferential edge portion 44.

Furthermore, according to another preferred embodiment of the present invention, which is shown in FIGS. 8*a* to 10, it is suggested that the power tool 1 comprises a turbine 60 attached to or forming an integral part of the eccentric element 17 on a part of the eccentric element 17 directed towards the eccentric seat 33 and the backing pad 9 connected thereto, respectively. Such a turbine 60 comprises a plurality of fins 61, with an essentially radial extension in respect to the eccentric element 17 (see FIG. 8*b*) and which upon rotation of the turbine 60 about the first rotational axis 10 create a radial or an axial air flow 62. In the embodiment of FIG. 8*a* the air flow 62 is directed in an essentially radial direction. The air flow 62 can be used for cooling internal components of the power tool 1 (e.g. electronic components such as an electric motor, an electronic control unit, electronic valves and switches, electric inductors or the like, or pneumatic components such as a pneumatic motor, pneumatic valves and switches) and/or for aspiring dust and other small particles (e.g. grinding dust, polishing dust, particles from a polishing agent) from the surface currently worked by the power tool 1 and/or from the surrounding environment and for conveying the aspired dust laden air 62 to a filter unit or to a vacuum cleaner (both not shown) attached to the power tool 1. The turbine 60 may further act as a counterweight, in particular as a primary counterweight 63 and/or as a secondary counterweight 64.

This embodiment has the advantage that the unit comprising the eccentric element 17 and the turbine 60 and possibly further comprising a magnetic transmission arrangement 40 (see FIGS. 8*a*, 8*b*) or an electric motor 15 (see FIGS. 9, 10) is particularly compact and has a flat design. The unit integrates a plurality of different components in a very small space. The design of the magnetic transmission arrangement 40 of FIGS. 8*a*, 8*b* is of a radial type, similar to that previously described in respect to the embodiment of FIGS. 3*a*, 3*b*. However, it is well possible that a magnetic transmission arrangement 40 of an axial type is used, similar to that of FIGS. 4*a*, 4*b*. The design of the electric motor 15 of FIGS. 9, 10 is of a radial type, similar to those previously described in respect to the embodiments of FIGS. 5 and 6, respectively. However, it is well possible that an electric motor 15 of an axial type is used, similar to that of FIG. 7.

FIGS. 12*a* and 12*b* show another preferred embodiment of the present invention. In particular, an axial magnetic transmission arrangement 40 similar to that shown in FIGS. 4*a* and 4*b* is integrated into the eccentric element 17. In contrast to the embodiment of FIGS. 4*a* and 4*b*, the first number of first permanent magnets 41 is not provided in a disk-shaped end section 45 of a driving shaft 18 but rather in a bottom recessed portion 54 of the rotor 53 of an axial electric motor 15, similar to the one shown in FIG. 7. The recessed portion 54 is limited in the radial direction by means of a circumferential end portion 55. The rotor 53 is guided in respect to the static body 31 by means of at least one additional bearing 56. A further recessed portion 57 is provided on the top surface of the rotor 53 and adapted for receiving the permanent magnets 52. The recessed portion 57 is limited in the radial direction by means of a circumferential end portion 58. The stator 51 is fixed to the static body 31. The permanent magnets 52 of the rotor 53 may be identical to the first permanent magnets 41 of the magnetic transmission arrangement 40. The modulator 46 is an optional component.

FIGS. 13*a* and 13*b* show yet another preferred embodiment of the present invention. In particular, a radial magnetic transmission arrangement 40 similar to that shown in FIGS. 3*a* and 3*b* is integrated into the eccentric element 17. In contrast to the embodiment of FIGS. 3*a* and 3*b*, the first number of first permanent magnets 41 is not provided in a disk-shaped end section 45 of a driving shaft 18 but rather on an external surface of the rotor 53 of an electric motor 15 of the inrunner type, similar to the one shown in FIG. 7. The permanent magnets 52 of the rotor 53 may be identical to the first permanent magnets 41 of the magnetic transmission arrangement 40. The modulator 46 is an optional component. The rotor 53 of the motor 15 is guided in respect to the static body 31 by means of two additional bearings 56.

FIGS. 14*a* and 14*b* show yet another preferred embodiment of the present invention. In particular, a radial magnetic transmission arrangement 40 similar to that shown in FIGS. 3*a* and 3*b* is integrated into the eccentric element 17. In contrast to the embodiment of FIGS. 3*a* and 3*b*, the first number of first permanent magnets 41 is not provided in a disk-shaped end section 45 of a driving shaft 18 but rather on a surface of the rotor 53 of an electric motor 15 of the outrunner type, similar to the one shown in FIG. 5, the rotor surface facing radially inwards. The permanent magnets 52 of the rotor 53 may be identical to the first permanent magnets 41 of the magnetic transmission arrangement 40 or they may be separate magnets. In contrast to the embodiment shown in FIGS. 3*a* and 3*b*, the second permanent magnets 42 of the magnetic transmission arrangement 40 are attached to an external surface of the eccentric element 17 facing radially outwards, opposite to the first permanent magnets 41. In particular, the eccentric element 17 comprises a cylindrical protrusion 59 having a smaller diameter than the rest of the eccentric element 17, and the sedon permanent magnets 42 are attached to the external surface of the protrusion 59. The modulator 46 is an optional component. The rotor 53 of the motor 15 is guided in respect to the static body 31 by means of two additional bearings 56.

FIGS. 15*a* to 17*b* show further preferred embodiments of the present invention, corresponding to the embodiments of FIGS. 12*a* to 14*b*, but additionally comprising a turbine 60 similar to the one of FIGS. 8*a* to 10.

The invention claimed is:

1. A hand-held and hand-guided random orbital polishing or sanding power tool (1), having a static body (31) being a fixed part of the hand-held and hand-guided random orbital polishing or sanding power tool (1) which does not move during operation of the hand-held and hand-guided random orbital polishing or sanding power tool (1), a motor (15), an eccentric element (17) driven by the motor (15) and performing a rotational movement about a first rotational axis (10), and a plate-like backing pad (9) connected to the eccentric element (17) in a manner rotatable in respect to the eccentric element (17) about a second rotational axis (16), the first rotational axis (10) and the second rotational axis (16) extending essentially parallel to one another and are spaced apart from one another, wherein an external circumferential surface of the eccentric element (17) has a rotationally symmetric part having at least discrete rotational symmetry in respect to the first rotational axis (10);

the hand-held and hand-guided random orbital polishing or sanding power tool (1) comprises at least one first bearing (30) provided between the rotationally symmetric part of the external circumferential surface of the eccentric element (17) and the static body (31) of the hand-held and hand-guided random orbital polishing or sanding power tool (1) so that the eccentric element (17) is guided in respect to the static body (31) in a manner rotatable about the first rotational axis (10);

the hand-held and hand-guided random orbital polishing or sanding power tool (1) is a random orbital polisher or sander, where the plate-like backing pad (9) is connected to the eccentric element (17) in a manner freely rotatable about the second rotational axis (16); and the hand-held and hand-guided random orbital polishing or sanding power tool (1) comprises a magnetic gear arrangement (40) provided functionally between a driving shaft (18) and the eccentric element (17), the driving shaft (18) having a rotational axis corresponding to the first rotational axis (10), the magnetic gear arrangement (40) comprising a first number of first permanent magnets (41) attached to the driving shaft (18) with alternating polarities and a second number of second permanent magnets (42) attached to the eccentric element (17) with corresponding alternating polarities and opposite to the first permanent magnets (41).

2. The hand-held and hand-guided random orbital polishing or sanding power tool (1) according to claim 1, wherein the rotationally symmetric part of the external circumferential surface of the eccentric element (17) has a rotational symmetry in respect to a rotation about the first rotational axis (10) by any angle.

3. The hand-held and hand-guided random orbital polishing or sanding power tool (1) according to claim 1, wherein the at least one first bearing (30) is a ball race.

4. The hand-held and hand-guided random orbital polishing or sanding power tool (1) according to claim 1, wherein the hand-held and hand-guided random orbital polishing or sanding power tool (1) comprises at least two first bearings (30) provided between the rotationally symmetric part of the external circumferential surface of the eccentric element (17) and the static body (31) of the hand-held and hand-guided random orbital polishing or sanding power tool (1), the at least two first bearings (30) being spaced apart from each other in a direction along the first rotational axis (10).

5. The hand-held and hand-guided random orbital polishing or sanding power tool (1) according to claim 1, wherein the eccentric element (17) comprises a fulcrum pin (34) connected to the eccentric element (17) in a freely rotatable manner about the second rotational axis (16) and comprising an enlarged head portion (35) adapted for insertion into a respective recess provided on a top surface of the plate-like backing pad (9) and for releasable attachment of the plate-like backing pad (9) to the fulcrum pin (34).

6. The hand-held and hand-guided random orbital polishing or sanding power tool (1) according to claim 5, wherein the eccentric element (17) comprises at least one second bearing (37) provided between the eccentric element (17) and the fulcrum pin (34) so that the fulcrum pin (34) is guided in respect to the eccentric element (17) in a freely rotatable manner about the second rotational axis (16).

7. The hand-held and hand-guided random orbital polishing or sanding power tool (1) according to claim 6, wherein the at least one first bearing (30) is located on the rotationally symmetric part of the external circumferential surface of the eccentric element (17) in such a manner that it surrounds at least part of the at least one second bearing (37).

8. The hand-held and hand-guided random orbital polishing or sanding power tool (1) according to claim 1, wherein the first number of first permanent magnets (41) is attached to a circumferential outer surface of the driving shaft (18), and the second number of second permanent magnets (42) is attached to a circumferential inner surface of the eccentric element (17).

9. The hand-held and hand-guided random orbital polishing or sanding power tool (1) according to claim 1, wherein the first number of first permanent magnets (41) is attached to the driving shaft (18) opposite to a side of the eccentric element (17) to which the plate-like backing pad (9) is connected, and the second number of second permanent magnets (42) is attached to an end face of the eccentric element (17).

10. The hand-held and hand-guided random orbital polishing or sanding power tool (1) according to claim 8, wherein the magnetic gear arrangement (40) further comprises a modulator (46) with a third number of ferromagnetic segments (47) attached to the static body (31) of the hand-held and hand-guided random orbital polishing or sanding power tool (1), wherein the ferromagnetic segments (47) are located between the first permanent magnets (41) and the second permanent magnets (42).

11. The hand-held and hand-guided random orbital polishing or sanding power tool (1) according to claim 2, wherein the at least one first bearing (30) is a ball race.

12. The hand-held and hand-guided random orbital polishing or sanding power tool (1) according to claim 2, wherein the hand-held and hand-guided random orbital polishing or sanding power tool (1) comprises at least two first bearings (30) provided between the rotationally symmetric part of the external circumferential surface of the eccentric element (17) and the static body (31) of the hand-held and hand-guided random orbital polishing or sanding power tool (1), the at least two first bearings (30) being spaced apart from each other in a direction along the first rotational axis (10).

13. The hand-held and hand-guided random orbital polishing or sanding power tool (1) according to claim 2, wherein the eccentric element (17) comprises a fulcrum pin (34) connected to the eccentric element (17) in a freely rotatable manner about the second rotational axis (16) and comprising an enlarged head portion (35) adapted for insertion into a respective recess provided on a top surface of the plate-like backing pad (9) and for releasable attachment of the plate-like backing pad (9) to the fulcrum pin (34).

14. The hand-held and hand-guided random orbital polishing or sanding power tool (1) according to claim 2, wherein the first number of first permanent magnets (41) is attached to a circumferential outer surface of the driving shaft (18), and the second number of second permanent magnets (42) is attached to a circumferential inner surface of the eccentric element (17).

* * * * *